US006205694B1

(12) United States Patent
Davis, Sr.

(10) Patent No.: US 6,205,694 B1
(45) Date of Patent: Mar. 27, 2001

(54) EXTERNALLY ADJUSTABLE COIL HAMMER MAINSPRING ASSEMBLIES FOR PISTOLS

(76) Inventor: James Jefrey Davis, Sr., 11228 Hwy. 151, Trion, GA (US) 30753

( * ) Notice: Subject to any disclaimer, the term of this patent is extended or adjusted under 35 U.S.C. 154(b) by 0 days.

(21) Appl. No.: 09/082,027

(22) Filed: Aug. 3, 1998

Related U.S. Application Data

(63) Continuation-in-part of application No. 08/844,224, filed on Apr. 18, 1997, now abandoned, and a continuation-in-part of application No. 08/815,270, filed on Mar. 10, 1997, now abandoned.

(51) Int. Cl.[7] ..... F41A 17/74
(52) U.S. Cl. ..... 42/69.03; 42/70.08; 42/22
(58) Field of Search ..... 42/70.08, 69.03, 42/20, 21, 22

(56) References Cited

U.S. PATENT DOCUMENTS 1,141,256 * 6/1915 Nelson ..... 42/75.03
1,344,884 * 6/1920 Guyot ..... 42/69.03
1,712,411 * 5/1929 Walther ..... 42/69.03
2,691,232 * 10/1954 Hoopes ..... 42/70.08
2,945,316 * 7/1960 Mulno ..... 42/70.08
4,967,502 * 11/1990 Vernon ..... 42/70.08
5,361,525 * 11/1994 Bowes ..... 42/70.08

FOREIGN PATENT DOCUMENTS

120493 * 12/1930 (AT) ..... 42/69.03
495194 * 2/1976 (AU) ..... 42/69.03

OTHER PUBLICATIONS

Alchemy Arms Company; Spectve Performance, Technology, and Safety, 2 pages No Date.*

* cited by examiner

*Primary Examiner*—Stephen M. Johnson

(57) ABSTRACT

An externally adjustable coil hammer mainspring assembly for pistols having several different mechanisms for clearing obstructing internal and external pistol design features. These mechanisms make it possible to incorporate external coil hammer mainspring adjustment on many popular pistols. Finger-adjustable drive mechanisms (44, 46, and 30) as well as tool driven drive mechanisms (12) are provided to allow the pistol user to adjust coil hammer mainspring tension. This capability allows the user to adjust trigger-pull and hammerfall force in the field and provides a locking safety mechanism which locks down the pistol firing train including the trigger, sear, hammer and hammerstrut.

2 Claims, 31 Drawing Sheets

EXTERNALLY ADJUSTABLE COIL HAMMER MAINSPRING ASSEMBLIES FOR PISTOLS

Continuation-in-Part

This application is a continuation-in-part of application Ser. No. 08/844,224, filed Apr. 18, 1997 now abandoned and a CIP of application Ser. No. 08/815,270, filed on Mar. 10, 1997, now abandoned.

BACKGROUND—FIELD OF INVENTION

This invention relates to pistols, specifically to externally adjustable coil hammer mainspring assemblies for pistols.

BACKGROUND—DESCRIPTION OF PRIOR ART

A review of prior art hammer mainspring design indicates three basic types of hammer mainsprings. The first type, the flat or leaf spring design, is found in many rifles and pistols, both old and new. The desire to make these mainsprings externally adjustable was known as early as 1905 as evidenced by Mason U.S. Pat. No. 846,591 which provided an external screw adjustment to the leaf spring of an automatic rifle. A more recent (1982) example of an adjustable leaf-spring in a pistol is shown in Karlsen U.S. Pat. No. 4,361,072.

The second mainspring type is relatively rare and entails a spiral hammerspring which is a rolled up piece of flat steel which resembles a clock mainspring. An adjustable version of this mainspring type is found in Brinkerhoff U.S. Pat. No. 1,711,874.

The third mainspring type found in firearms is the helical coil mainspring. These mainsprings have been utilized in both rifles and pistols for quite some time. An early (1914) example of a rifle with a non-externally adjustable helical coil mainspring can be found in Swebilius U.S. Pat. No. 1,103,228.

A review of foreign and domestic patents and firearms literature revealed a total of two 1950's era starter pistols and no rifles with externally adjustable helical coil mainspring assemblies. All other coil hammer mainspring rifles and pistols are adjustable only by disassembling the gun. The first, covered under German patentanmeldung E 9365 XI/72b to Eberwein, is a starter pistol with a short helical coil mainspring which is adjustable via a slotted threaded plug in the butt end of the pistol housing. The second, shown in German patentschrift 830,465 to Gerstenberger, is also a starter pistol with a helical coil mainspring which is adjustable via a slotted threaded rod which passes through and meshes with a threaded nut which is affixed to the inside of the butt end of the pistol housing.

The prior art relating to the coil hammer mainspring has a number of disadvantages. For example, the coil hammer mainspring may experience fatigue and its tension may weaken over time, affecting hammerfall strike force which can interfere with a firearms ability to properly detonate a cartridge. Trigger-pull may also be affected by this weakened mainspring. Also, the pistol operator may not like the trigger-pull and/or hammerfall force currently existing in their pistol and may desire to change it to suit their needs. Arguably, the worst case scenario is a broken coil hammer mainspring which renders the firearm inoperable. Thus, with the exception of two 1950's era starter pistols, the prior art requires the gun owner to visit a gunsmith who will be required to disassemble the firearm and change-out the coil hammer mainspring to adjust coil hammer mainspring tension. This process is, of course, time consuming, costly, and quite unacceptable in a situation where coil hammer mainspring adjustment is needed now, not later.

The two 1950's era starter pistols have design characteristics which make the capability they possess, that of external coil hammer mainspring adjustment, not transferable to many of the pistols in service today. This occurs because neither of these pistols incorporated design features which allow the external drive mechanism to bypass internal or external obstructing gun parts. These design deficiencies prohibit incorporation of external coil hammer mainspring adjustment on many widely popular pistols, including but not limited to, the Colt 1911, the Beretta 92, the Smith and Wesson model 659, the Browning 9 mm Hipower, and all Para-Ordinance models.

Another disadvantage to the design of the two 1950's era starter pistols is that neither can be adjusted without tools. If the pistol user is out in the field without the right tool, external adjustment is of no help.

SUMMARY OF THE INVENTION

It is therefore a primary object of the present invention to provide a firearm, such as a pistol, with a helical coil hammer mainspring external adjustment, thereby permitting trigger-pull and hammerfall strike force to be adjusted in the field. An additional object is to permit the firearm owner, in many cases, to make the firearm function with a broken coil hammer mainspring. Other objects and advantages of the present invention are:

(a) to allow externally adjustable coil hammer mainspring housing assemblies to be incorporated in pistols which have internal design features which would otherwise prohibit the inclusion of external adjustment given the prior art;

(b) to provide trigger-pull and hammerfall force adjustment in the field without the use of tools;

(c) to allow externally adjustable coil hammer mainspring assemblies to be incorporated into pistols which have external design features which would otherwise prohibit the inclusion of external adjustment given the prior art. A good example of this is the Beretta model 92 which has a lanyard on the butt end of the pistol which is aligned with the axis of the coil mainspring; and (d) To provide a unique safety device which disables the pistol.

Still further objects and advantages will become apparent from a consideration of the ensuing description and drawings;

Figure 1A:
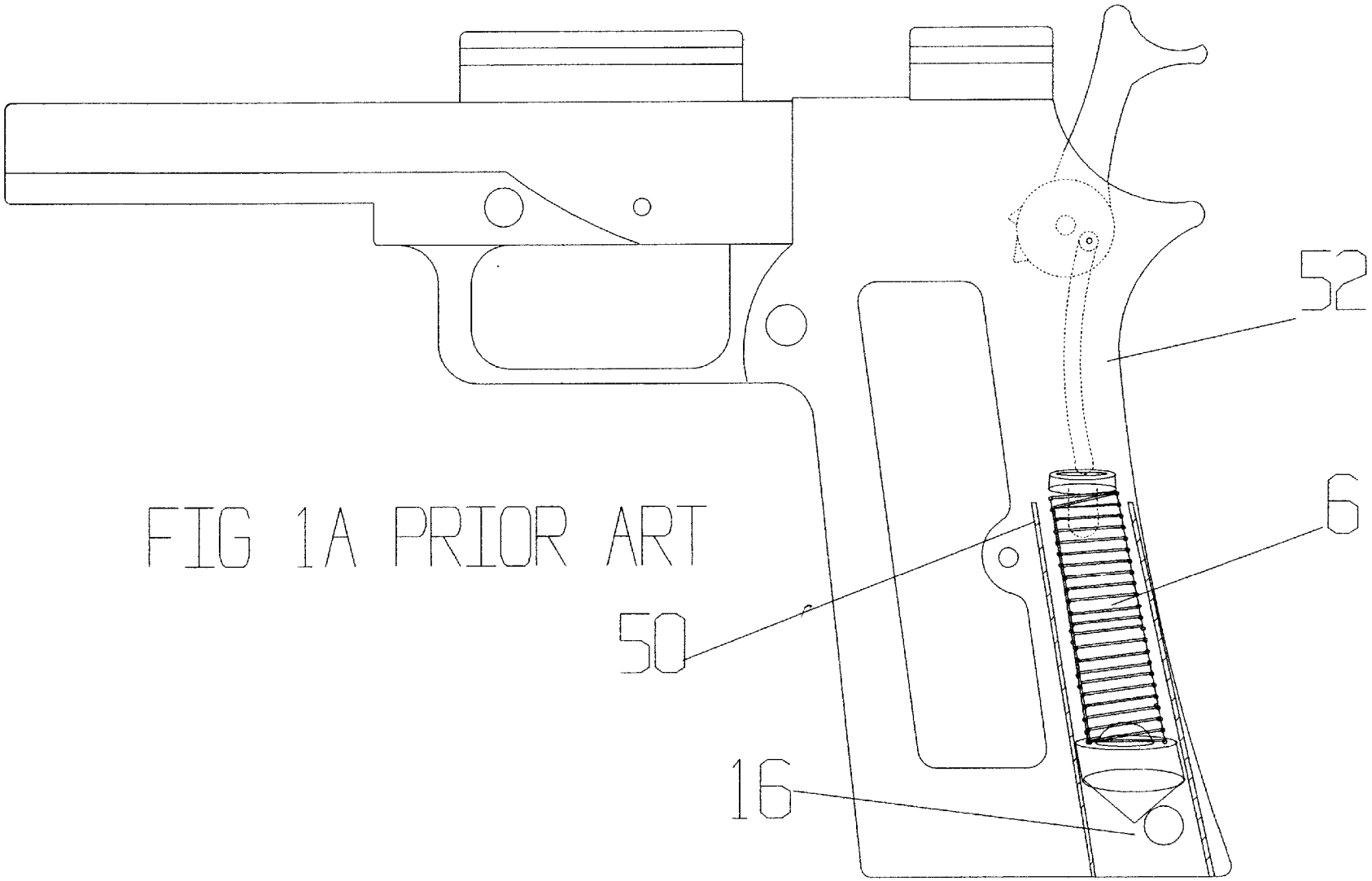
FIG 1A PRIOR ART
FIG. 1A shows a side view of a prior art pistol action without external coil hammer mainspring adjustment capability.

| Reference Numerals in Drawings | |
|---|---|
| 2 | hammer |
| 4 | hammerstrut |
| 6 | coil mainspring |
| 8 | pivoting device-female |
| 10 | threaded drive rod |
| 12 | slotted drive end |
| 14 | threaded housing exit hole |
| 16 | frame pin |
| 18 | pivoting device-ball end |
| 20 | protruding element |
| 22 | socket |
| 24 | sear |
| 26 | hammer full cock notch |
| 28 | trigger |
| 30 | lanyard |
| 32 | unpivoted threaded drive rod |
| 34 | firing pin |
| 36 | barrel |
| 38 | projectile |
| 40 | threaded plug |
| 42 | threaded housing exit hole for lanyard plug |
| 44 | knurled knob |
| 46 | folding D-ring |
| 48 | reserved |
| 50 | mainspring housing |
| 52 | pistol housing |
| 54 | two short unthreaded frame pins |
| 56 | flanged head |
| 58 | single short unthreaded frame pin |
| 60 | unthreaded hole in pistol housing |
| 62 | unthreaded hole in the mainspring housing |
| 64 | two short threaded frame pins |
| 66 | hex head end |
| 68 | single short threaded frame pin |
| 70 | threaded hole in pistol housing |
| 72 | threaded hole in mainspring housing |
| 74 | gun grip |
| 76 | frame pin with threaded center hole |
| 78 | spring end |
| 80 | unthreaded housing exit hole |
| 82 | frame pin with unthreaded center hole |
| 84 | threaded center hole |
| 86 | mainspring housing drive device |
| 88 | adjusting groove |
| 90 | detent slots |
| 92 | unthreaded hole in mainspring housing drive device |
| 94 | two adjusting grooves |
| 96 | key locking safety mechanism |
| 98 | safety locking hollow pins |
| 100 | key lock cylinder |
| 102 | key hole slot |
| 104 | key |

DESCRIPTION OF THE PREFERRED EMBODIMENT

Figure 1B:
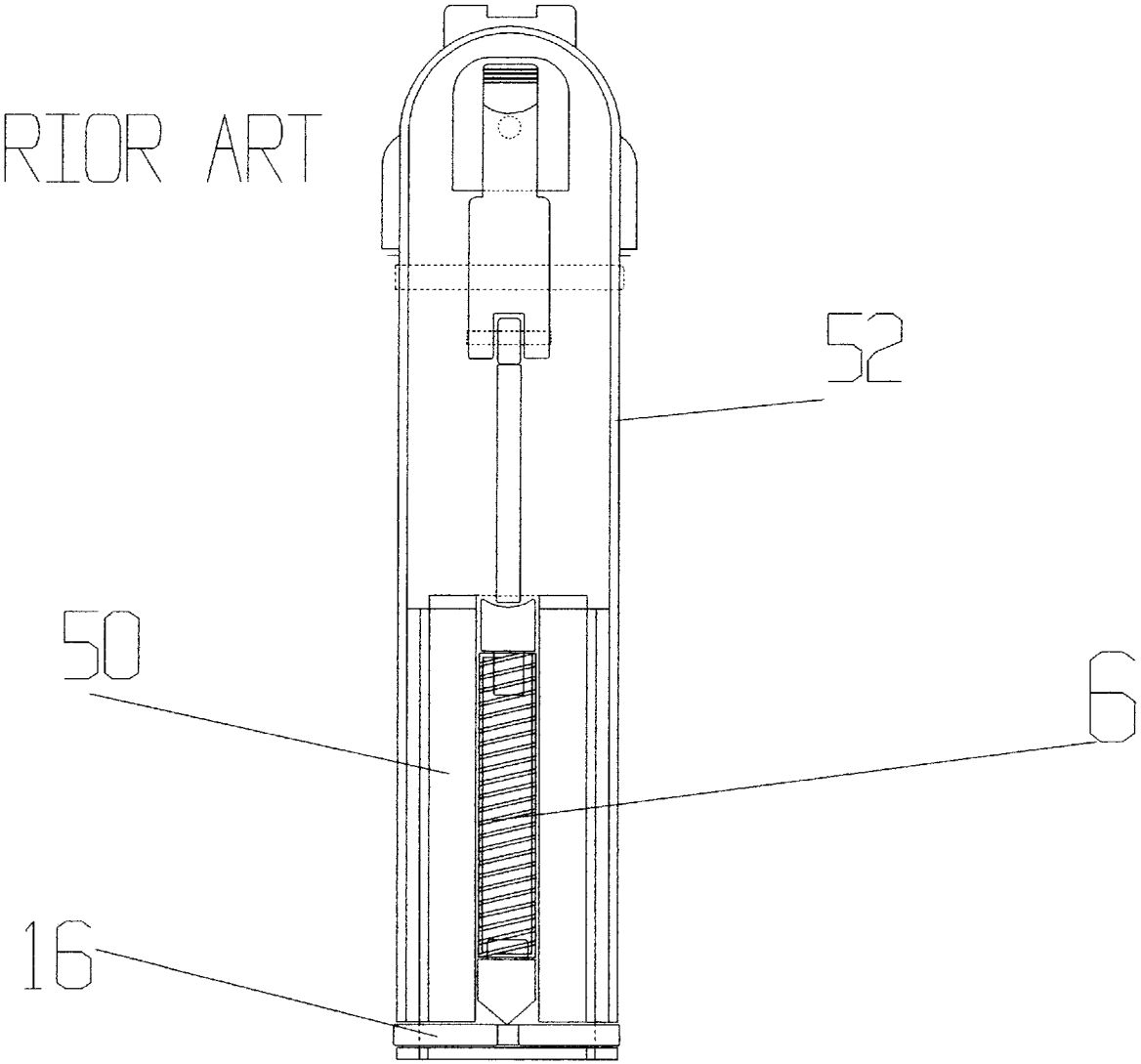
FIG 1B PRIOR ART
FIG. 1B shows a rear cutaway view of the prior art pistol action shown in FIG. 1A.

A prior art pistol is illustrated—FIG. 1A and FIG. 1B, the pistol having a coil hammer mainspring which is not externally adjustable. FIG. 1A shows a side view and FIG. 1B shows a rear cutaway view. A frame pin 16 has a dual purpose; it provides a stop for a coil mainspring 6 and secures a mainspring housing 50 within a pistol housing 52. Pin 16 blocks incorporation of external adjustment means with all prior art externally adjustable coil hammer mainspring designs as pin 16 sits directly in the axis of coil mainspring 6. Additionally, many pistols have a lanyard which blocks incorporation of external adjustment by being directly aligned with the axis of the mainspring.

Figure 2:
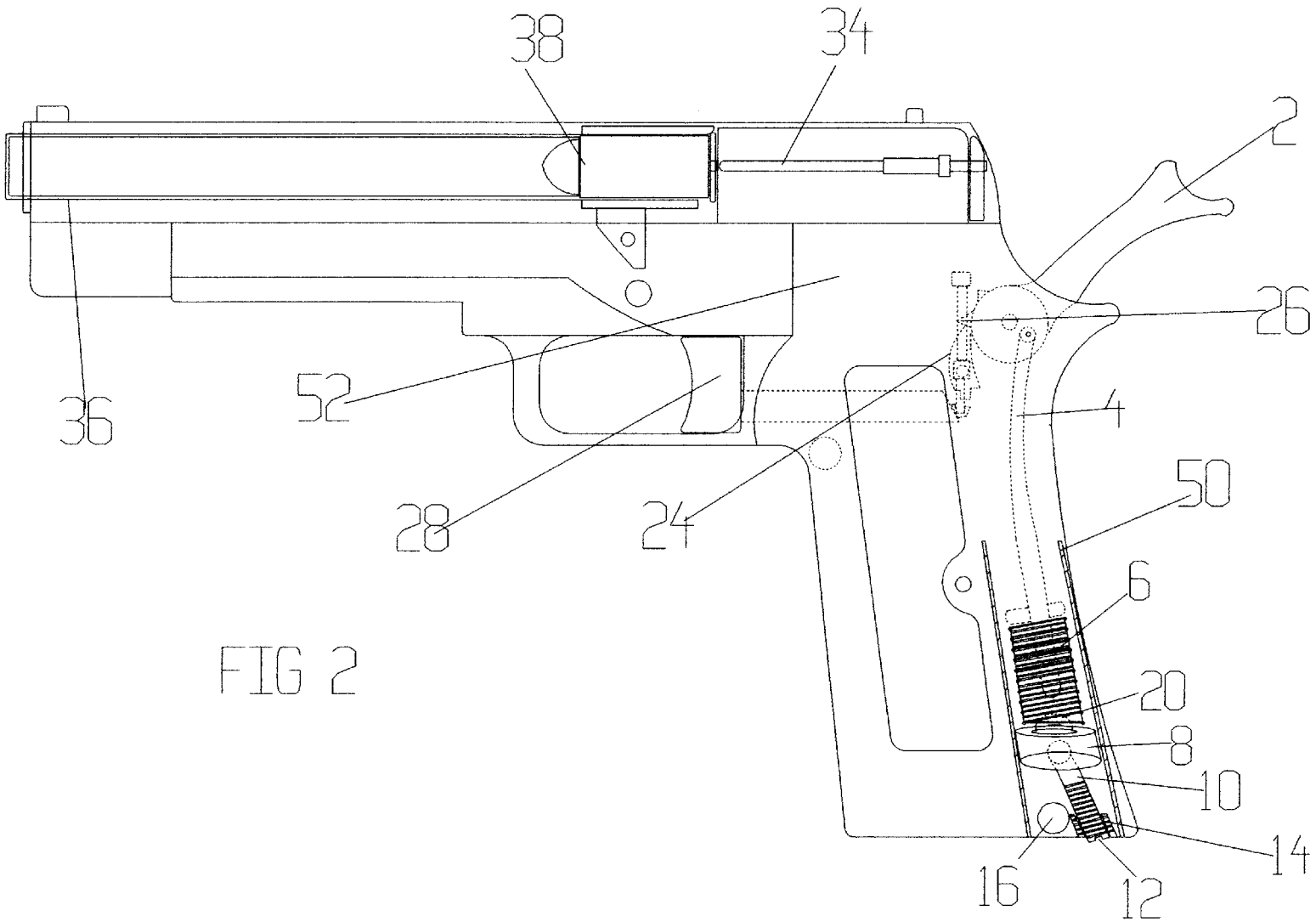
FIG. 2 shows a pistol action with an externally adjustable coil hammer mainspring assembly that has a pivoting device between the coil spring and the external drive.
Figures 3A, 3B:
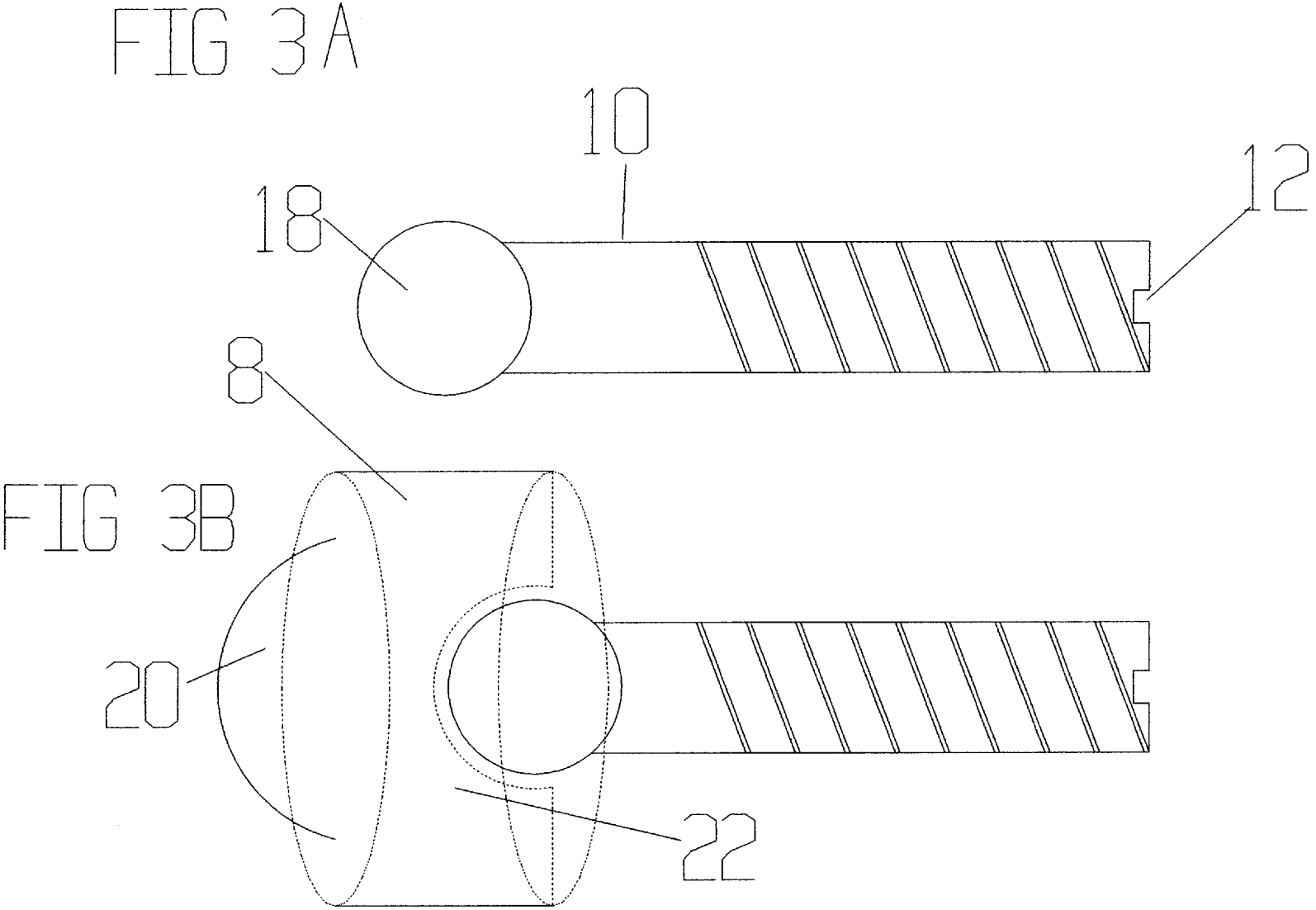
FIG. 3A provides a detailed view of the pivoting rod.
FIG. 3B provides a detailed view of the pivoting assembly.

The preferred embodiment of the externally adjustable coil hammer mainspring with pivoting ability is illustrated in FIG. 2, FIG. 3A and FIG. 3B. The assembly includes a pistol housing 52, a hammer 2, a trigger 28, a sear 24, a hammer full cock notch 26, a firing pin 34, a barrel 36, a projectile 38, a mainspring housing 50, a hammerstrut 4, a coil mainspring 6 and a pivoting device-female 8. The pivoting device-female 8 has a socket 22 on a drive-end side and a protruding element 20 on the coil spring side. A threaded drive rod 10 is connected by fitting a pivoting device-ball end 18 into socket 22. FIG. 3A provides a closer view of threaded drive rod 10 and pivoting device-ball end 18. FIG. 3B shows a close up view of the pivoting assembly. Threaded drive rod 10 passes through a threaded housing exit hole 14 and terminates in a slotted drive end 12. Frame pin 16 is shown and is the reason why a pivoting mechanism is utilized to incorporate external coil hammer mainspring adjustment into the pistol as pin 16 would block a rod which is aligned with the axis of mainspring 6.

The manner of using the externally adjustable coil hammer mainspring assembly is straightforward. In FIG. 2, threaded drive rod 10 is rotated by inserting a flat head screwdriver into slotted drive end 12 and turning. Because rod 10 is held by, and meshes with, threaded housing exit hole 14, rod 10 is driven upwards by a clockwise rotation of the screwdriver. Rod 10 is connected to pivoting device-female 8 via the ball-end of rod 10 and socket 22 of pivoting device-female 8 and said ball-end is retained in said socket 22 by the spring force of coil mainspring 6 on pivoting device-female 8 and socket 22. As such, this upward motion forces pivoting device-female 8 upward (contained in and guided by mainspring housing 50) which in turn pushes coil mainspring 6 upward with protruding element 20 centering mainspring 6. Mainspring 6, however, is held in place from the top by the shoulders of hammerstrut 4. The result is compression of mainspring 6, giving the spring increased tension. This increased tension exerts a greater force on hammer 2 via hammerstrut 4 which in turn exerts an increased force on hammer full cock notch 26 which in turn increases force on sear 24 at the point where notch 26 and sear 24 touch. When trigger 28 is pulled, the trigger-pull force required to disengage sear 24 from notch 26 is increased. Hammer 2 falls with a greater force due to the increased force on hammer 2 imparted by mainspring 6 through hammerstrut 4. Hammer 2 impacts firing pin 34 with a greater force which in turn impact projectile 38 with a greater force. In order to reduce mainspring tension, the process is reversed by inserting a screwdriver into slotted drive end 12 and turning counterclockwise. This reduces spring tension and reduces the force on hammerstrut 4, on hammer 2, on hammer full cock notch 26 and on sear 24. The result is less hammerfall force, less force required to pull trigger 28, less impact force on firing pin 34 and less impact force on projectile 38. This embodiment overcomes a flaw in all prior art pistols with externally adjustable coil hammer mainsprings in that none of these prior art pistols have design characteristics which allow the external drive mechanism to bypass an obstructing frame pin which is located in the axis of the mainspring.

Figure 5:
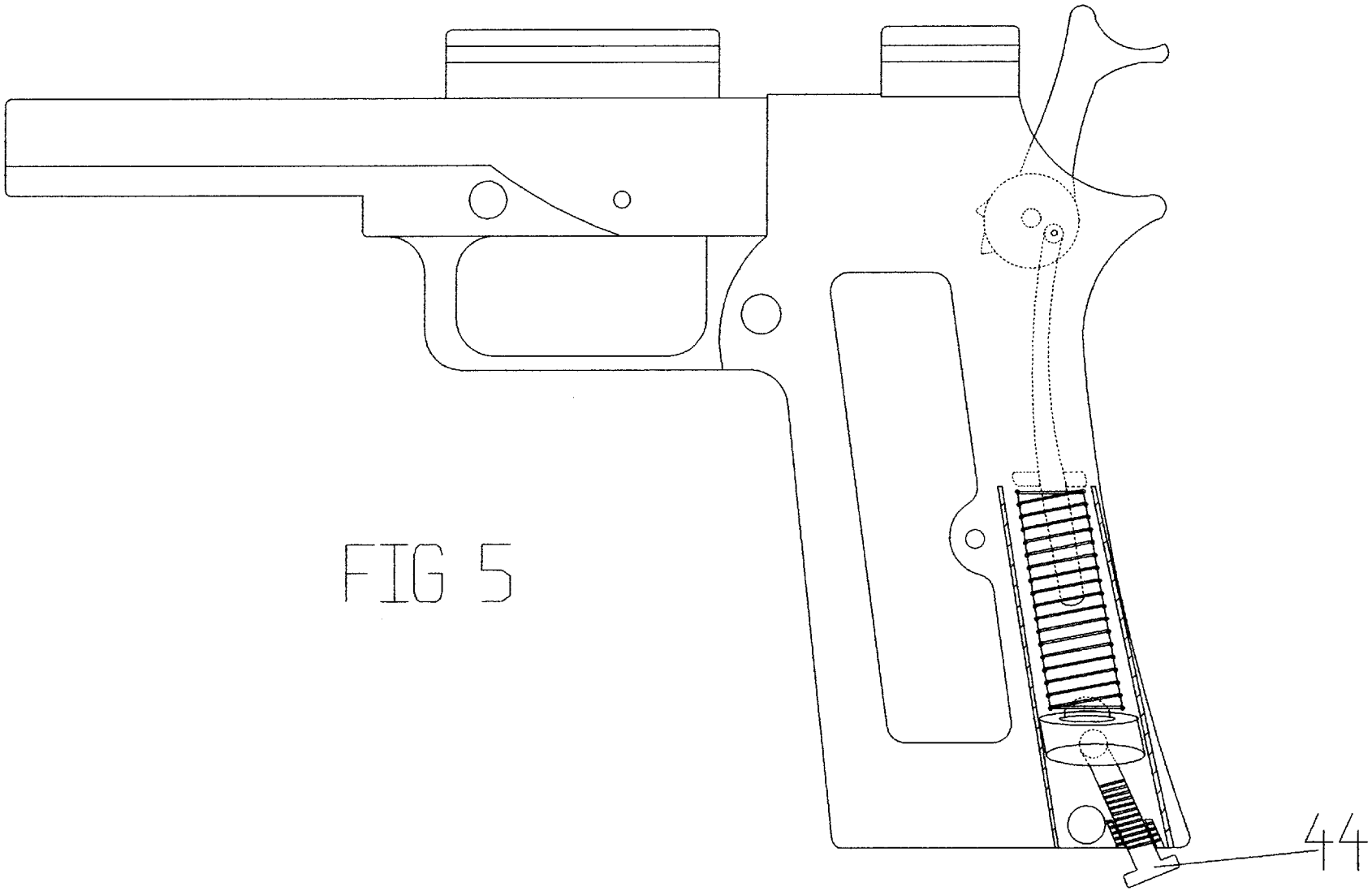
FIG. 5 shows one type of finger-adjustable control mechanism.

A second embodiment of the invention is illustrated—FIG. 5 wherein the adjusting drive mechanism is a knurled knob 44. FIG. 5 operates by rotating knob 44 with the fingers. Thereafter the function of FIG. 5 is identical to FIG. 2. This embodiment is a significant improvement over prior art externally adjustable coil hammer mainspring pistols which require some form of mechanical tool to make adjustments.

Figure 4A:
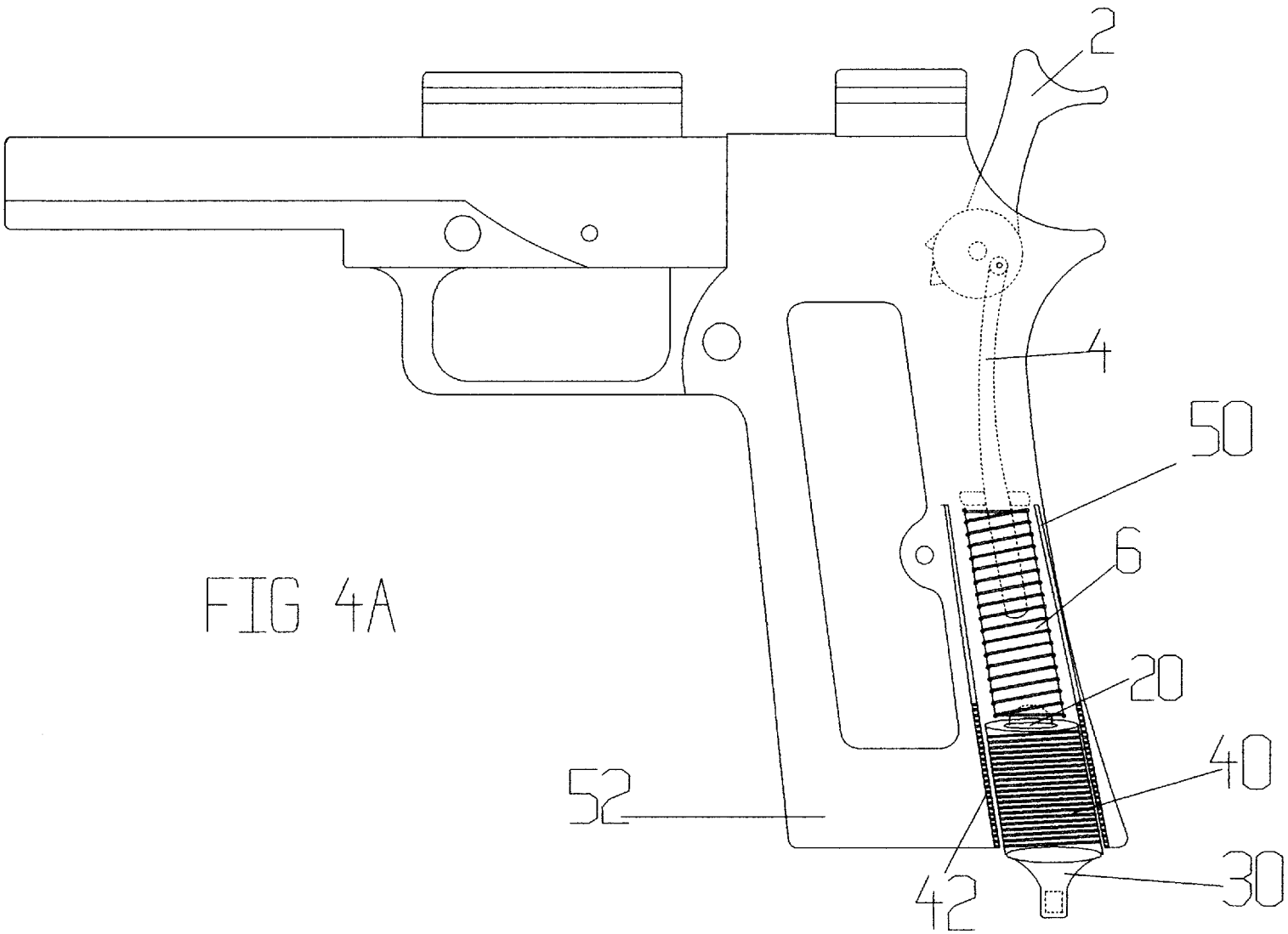
FIG. 4A shows a side view of a pistol action with a lanyard type externally adjustable coil hammer mainspring assembly.
Figure 4B:
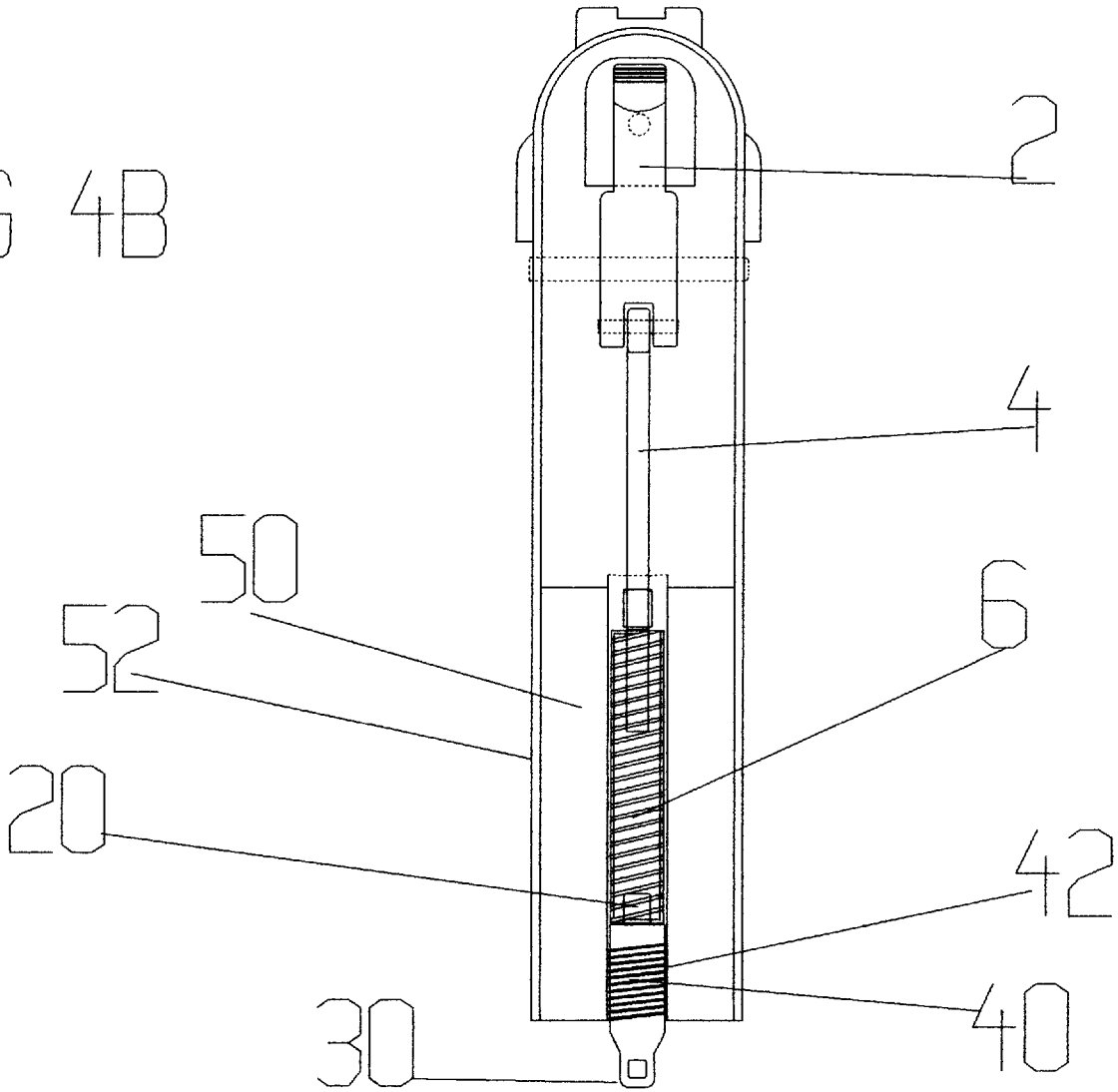
FIG. 4B shows a rear cutaway view of the pistol action shown in FIG. 4A.

A third embodiment is illustrated—FIGS. 4A and 4B which are a side view and a rear cutaway view respectively of a pistol action wherein the adjusting drive mechanism is a pistol lanyard. The assembly shown in the figures includes a hammer 2, a hammerstrut 4, a coil mainspring 6, a threaded plug 40, a lanyard 30, a threaded housing exit hole for lanyard 42 and a mainspring housing 50. In operation, a coil mainspring 6 is given increased spring tension by turning lanyard 30 with the fingers in a clockwise rotation. As lanyard 30 is directly connected to threaded plug 40 and plug 40 is held by and meshes with threaded housing exit hole for lanyard plug 42, threaded plug 40 is driven upwards by the clockwise rotation of lanyard 30 with protruding element 20 centering mainspring 6. The increased coil mainspring tension and subsequent effects are identical to the description of operation of FIG. 2 above. The unique and unobvious features of the manually operated lanyard in this embodiment are that a pistol with a fixed lanyard which is positioned directly in the axis of the coil hammer mainspring can now be modified to allow the lanyard to be retained as the external drive mechanism. In this embodiment, note that mainspring housing 50 is not a separate piece and is integrated into a pistol housing 52. Because of this integration, no frame pin is required to retain mainspring housing 50 into a pistol housing 52. However, if a frame pin was present, one or more of the methods in embodiments five through eight could be used for avoiding a blocking prior art frame pin such as that described in FIGS. 1A and 1B prior art.

Figure 6:
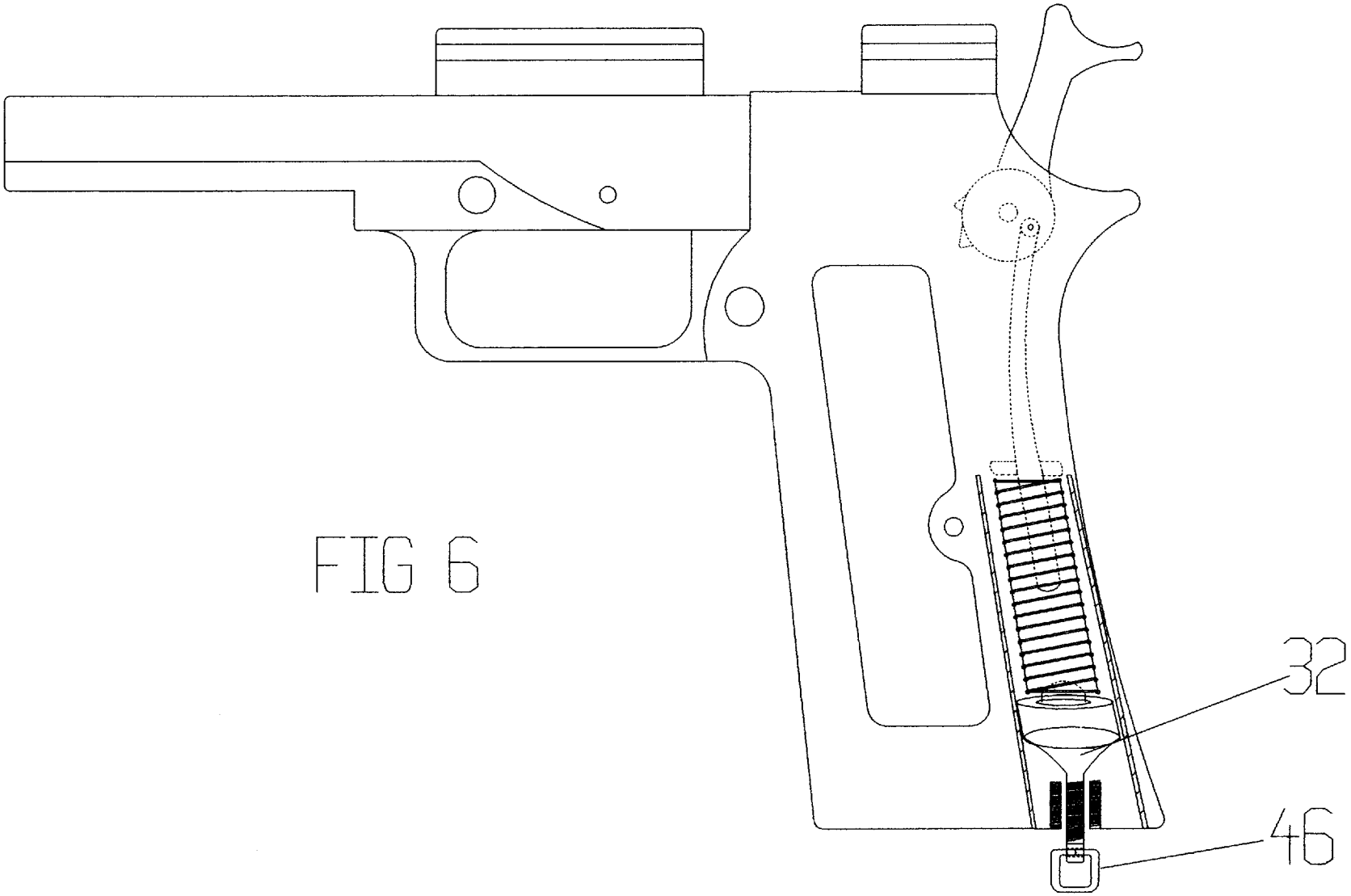
FIG. 6 shows a different finger-adjustable control mechanism in conjunction with an unpivoted drive rod assembly.

A fourth embodiment is illustrated—FIG. 6 wherein the adjusting drive mechanism is a folding D-ring 46. FIG. 6 operates by rotating D-ring 46 with the fingers which rotates unpivoted threaded drive rod 32. Thereafter the functional operating description is the same as FIGS. 7A and 7B below and the benefits are the same as in the second embodiment above.

Figure 7A:
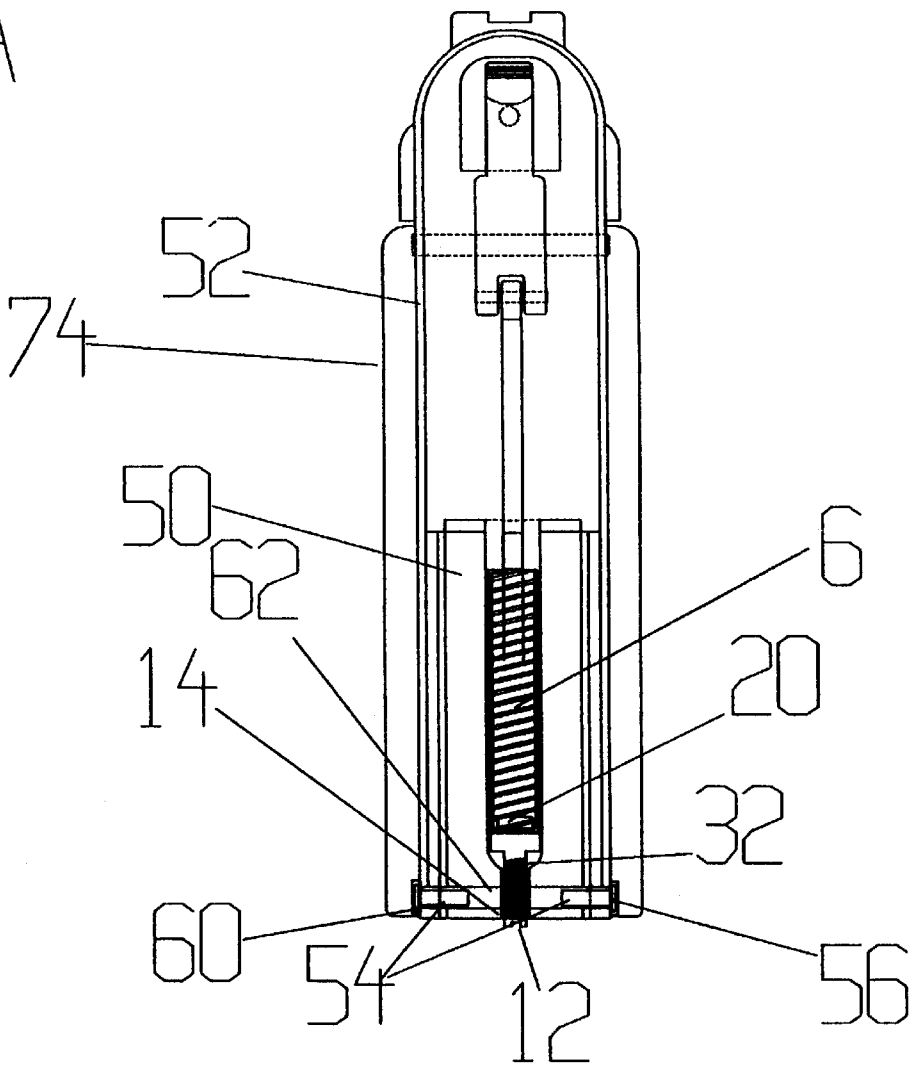
FIG. 7A shows a rear cutaway view of a pistol action with an externally adjustable coil hammer mainspring assembly that has two short unthreaded frame pins in place of the single prior art frame pin.
Figure 7B:
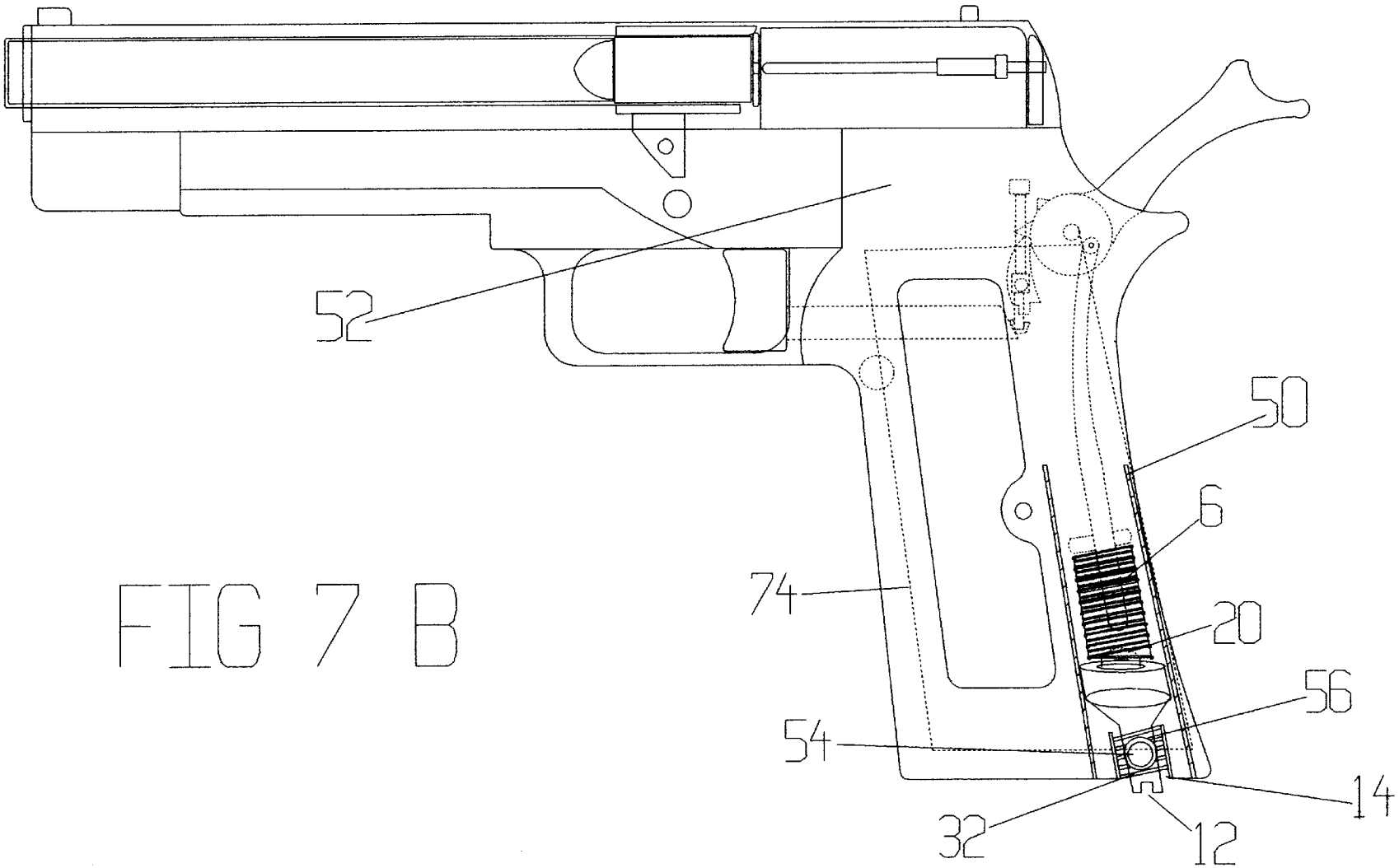
FIG. 7B shows a side view of the pistol action shown in FIG. 7A.

A fifth embodiment is illustrated—FIG. 7A and FIG. 7B which are a rear cutaway view and a side view respectively of a pistol action with a externally adjustable coil hammer mainspring assembly which utilizes two short unthreaded frame pins 54 which are pressed into a unthreaded hole in pistol housing 60 and a unthreaded hole in mainspring housing 62. Short frame pins 54 have a flanged head 56 which serve as a stop when pushing the pins in and provide a way to remove the pins. A gun grip 74 covers flanged head 56 and prevents pins 54 from falling out. This two pin arrangement allows the use of a unpivoted threaded drive rod 32 while providing the same level of housing integrity support as a prior art frame pin 16 does in FIG. 1A and FIG. 1B by connecting and holding a pistol housing 52 and a mainspring housing 50 together. Operation of this pistol action is as follows. Unpivoted threaded drive rod 32 is rotated by inserting a flat head screwdriver into a slotted drive end 12 and turning. Because rod 32 is held by, and meshes with, a threaded housing exit hole 14, rod 32 is driven upwards by a clockwise rotation of the screwdriver. This upward motion forces a coil spring 6 upward with a protruding element 20 centering a mainspring 6 and a mainspring housing 50 containing and guiding mainspring 6. The increased coil mainspring tension and subsequent effects are identical to the description of operation of FIG. 2 above. This two pin design overcomes the problem of a single frame pin which lies directly in the axis of the coil hammer mainspring as shown in FIGS. 1A and 1B prior art and which would otherwise prohibit incorporation of external adjustment with all prior art externally adjustable coil hammer mainspring pistols.

Figure 8A:
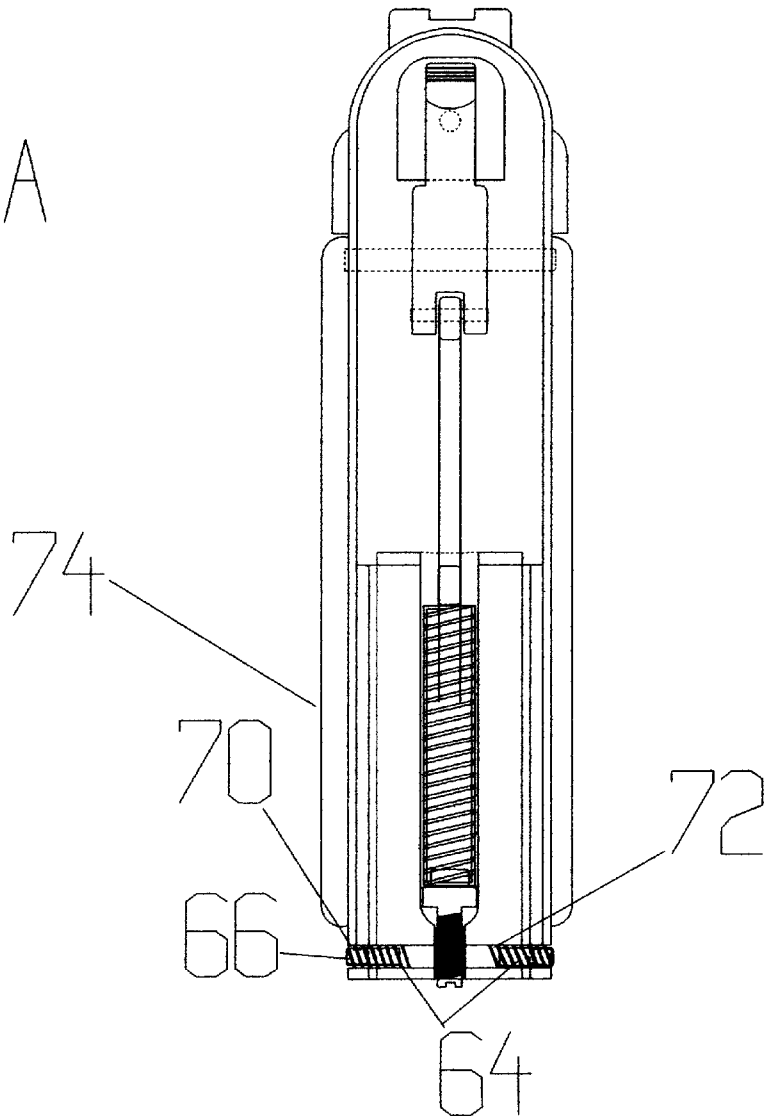
FIG. 8A shows a rear cutaway view of a pistol action with an externally adjustable coil hammer mainspring assembly that has two short threaded frame pins in place of a single prior art frame pin.
Figure 8B:
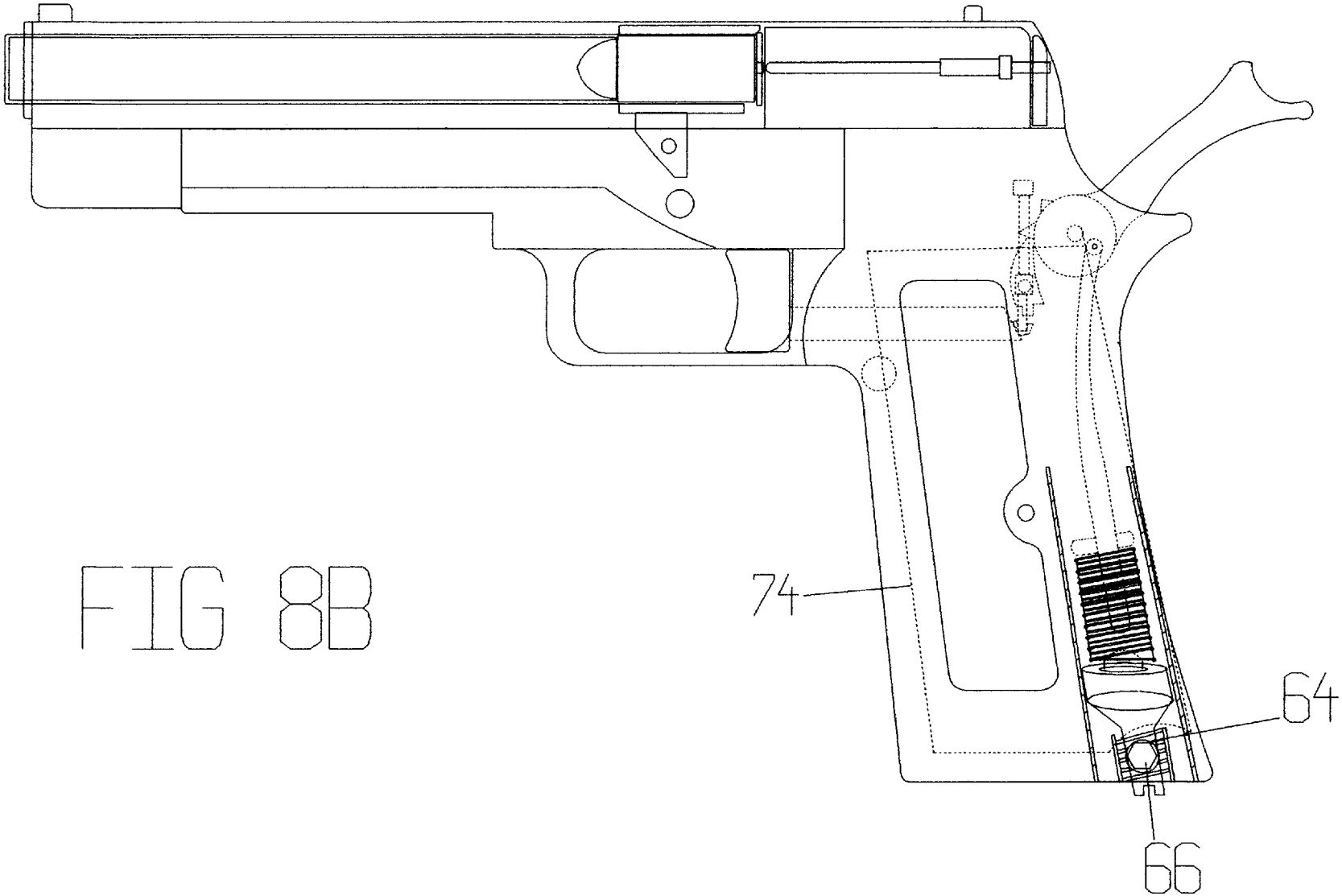
FIG. 8B shows a side view of the pistol action shown in FIG. 8A.

A sixth embodiment is illustrated—FIG. 8A and FIG. 8B which are a rear cutaway view and a side view respectively of a pistol action with an externally adjustable coil hammer mainspring assembly which is similar to FIGS. 7A and 7B. In this embodiment two short threaded frame pins 64 are utilized. Pins 64 are screwed into a threaded hole in pistol housing 70 and a threaded hole in mainspring housing 72. Each threaded frame pin 64 has a hex head end 66 which allows for its installation and removal. The threading of pins 64 and threaded hole 70 and threaded hole 72 provide a pin retention capability which is useful when a gun grip 74 does not cover and retain pins 64 as shown in FIG. 8B. Support to housing integrity and the operation of this embodiment is the same as described in FIGS. 7A and 7B above.

Figure 9:
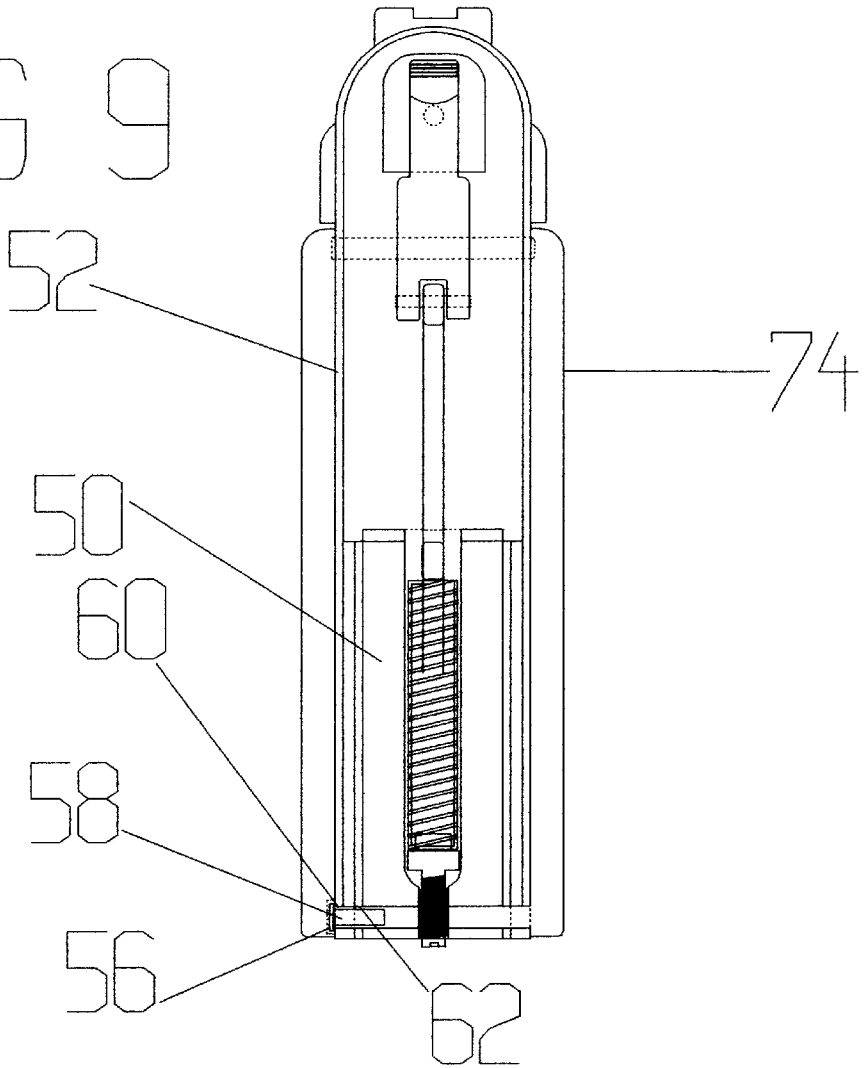
FIG. 9 shows a rear cutaway view of a pistol action with an externally adjustable coil hammer mainspring assembly that has a single short unthreaded frame pin in place of the longer single prior art frame pin.

A seventh embodiment is illustrated—FIG. 9 which is a rear cutaway view of a pistol action with an externally adjustable coil hammer mainspring assembly which is similar to FIGS. 7A and 7B except that instead of having two short unthreaded frame pins 54 as shown in FIGS. 7A and 7B, FIG. 9 shows a single short unthreaded frame pin 58 which passes through a unthreaded hole in pistol housing 60 and a unthreaded hole in mainspring housing 62. Pin 58 has a flanged head 56 which assists in installation and removal. A gun grip 74 covers flanged head 56 and holds it in place. Pin 58 maintains housing integrity by connecting and holding a pistol housing 52 and a mainspring housing 50 together. Operation of the embodiment is the same as described in FIGS. 7A and 7B above.

Figure 10:
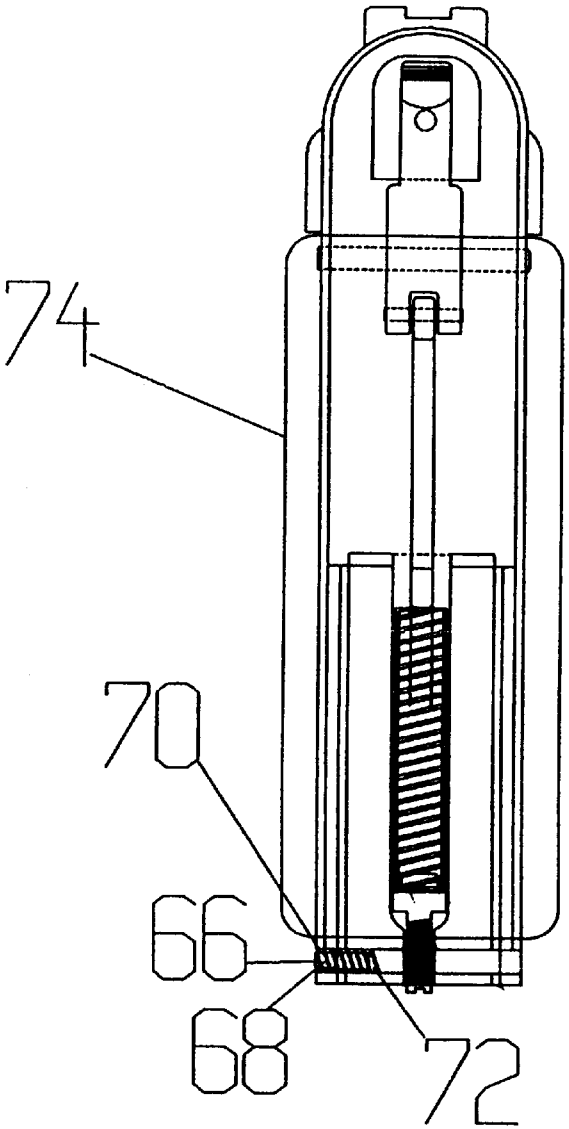
FIG. 10 shows a rear cutaway view of a pistol action similar to FIG. 9 except a single, short threaded frame pin is used.

An eighth embodiment is illustrated—FIG. 10 which is identical to FIG. 9 except that a single short unthreaded frame pin 58 of FIG. 9 is replaced by a single short threaded frame pin 68 which screws into a threaded hole in a pistol housing 70 and a threaded hole in mainspring housing 72. A flanged head 56 of FIG. 9 is replaced by a hex head end 66 in FIG. 10. Housing integrity is maintained as in FIG. 9 and the operation of this embodiment is the same as described in FIGS. 7A and 7B. This embodiment is useful when a gun grip 74 does not cover pin 68 and threading is desirable to hold pin 68 in place.

Figure 11A:
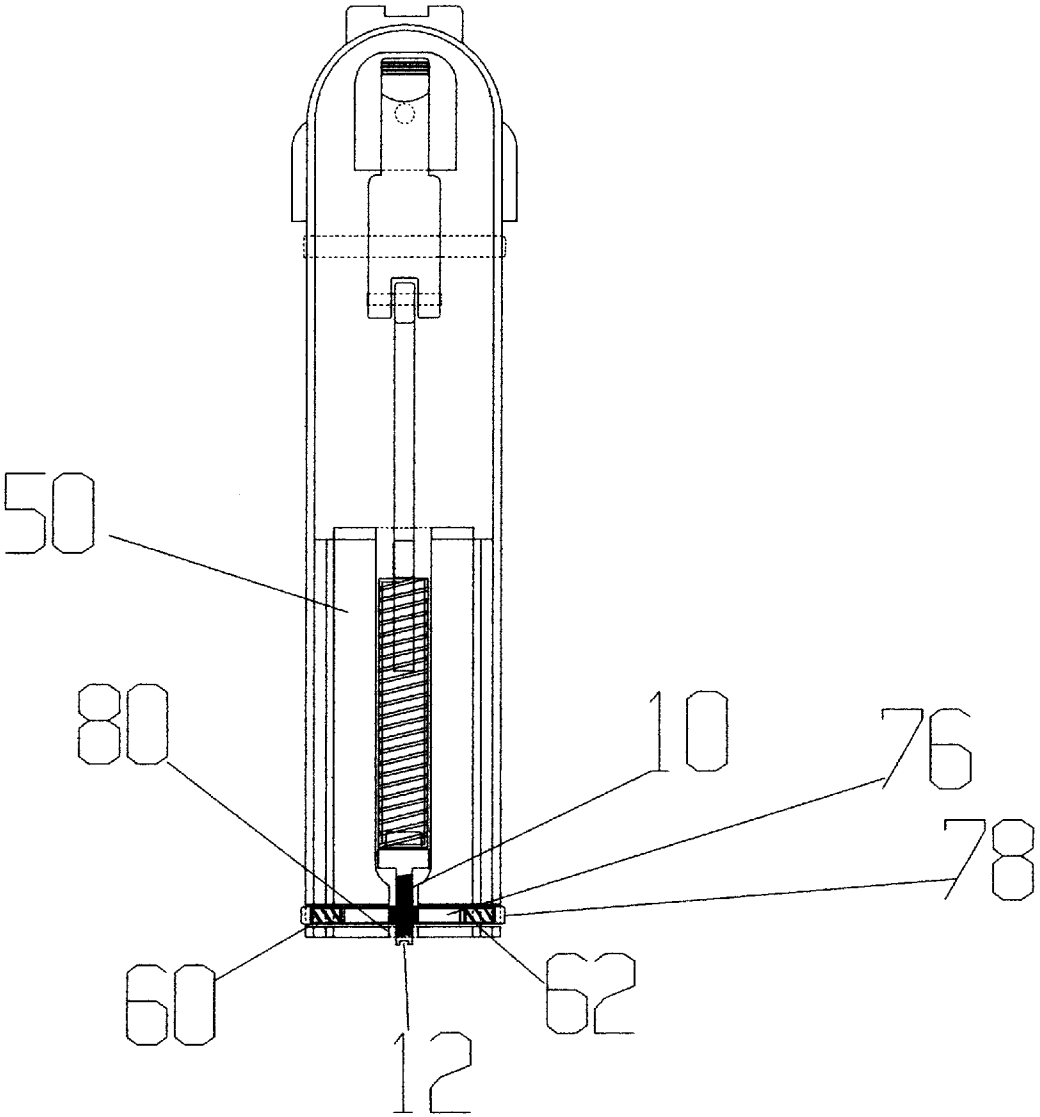
FIG. 11A shows a rear cutaway view of a pistol action with an externally adjustable coil hammer mainspring assembly that has a frame pin with a threaded hole in its' center.
Figure 11B:
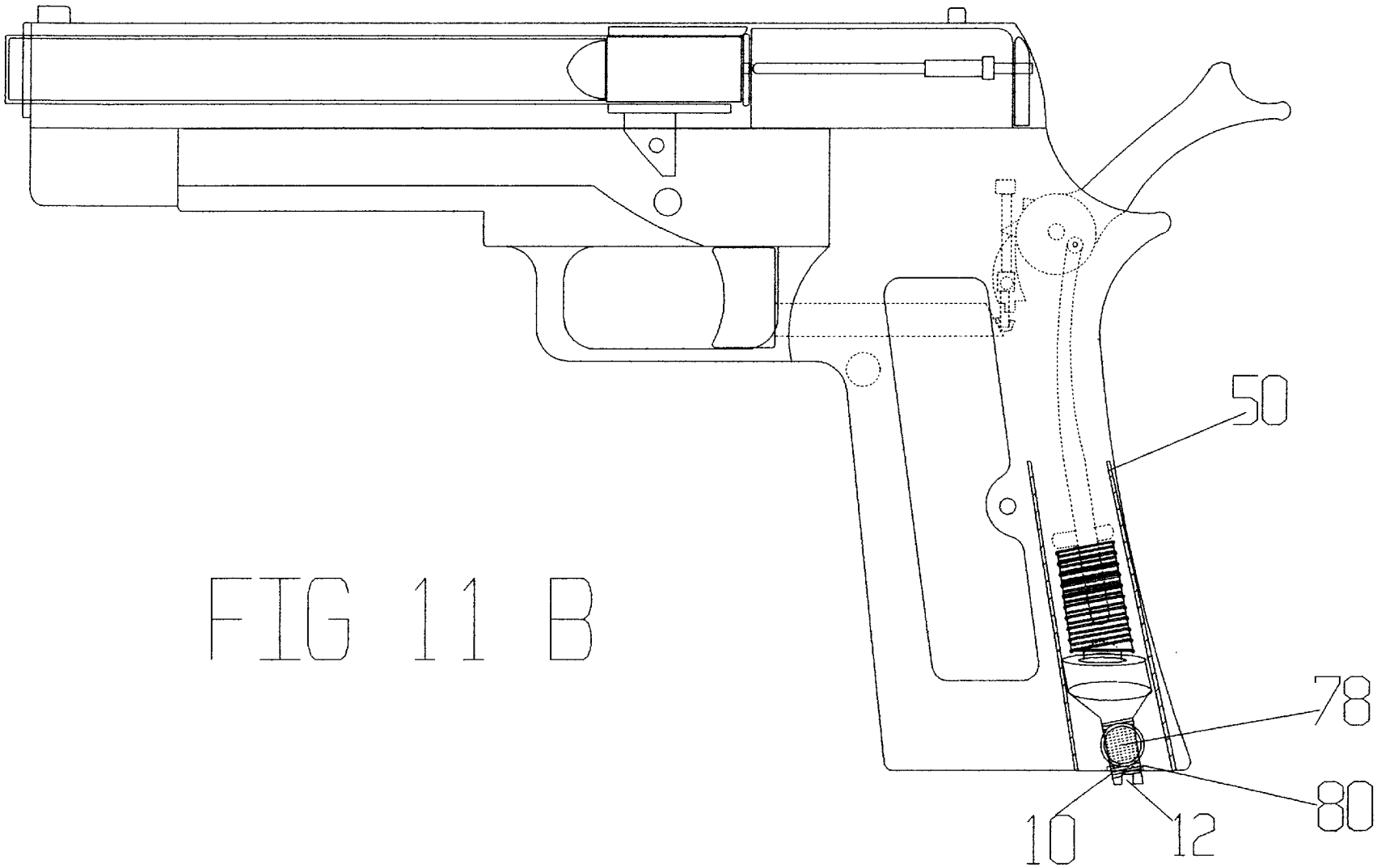
FIG. 11B shows a side view of the pistol action shown in FIG. 11A.

A ninth embodiment is illustrated—FIG. 11A and FIG. 11B show a rear cutaway view and side view respectively of a pistol action with an externally adjustable coil hammer mainspring assembly which utilizes a frame pin with center threaded hole 6. A close up view of pin 76 is illustrated—FIG. 11C. This pin is much like a watchband pin which connects a watchband to a watch body. Pin 76 has two spring ends 78 and a threaded center hole 84. Spring end 78 rests in a unthreaded hole in pistol housing 60 and a unthreaded hole in mainspring housing 62. Pin 76 is removed and installed like a watchband pin. Pin 76 is removed along with a mainspring housing 50 from the frame of the pistol in pistols designed with removable mainspring housing such as the Colt 1911. A threaded drive rod 10 passes through and meshes with a threaded center hole 84 of pin 76 and passes through a unthreaded housing exit hole 80 and terminates in a slotted drive end 12. Housing integrity is maintained in the same manner as prior art frame pin 16 in FIG 1A and FIG. 1B. Operation of this embodiment is as described in FIG. 7A and FIG. 7B with the exception that the center threaded hole of pin 76 substitutes for and has the same operative effect as a threaded housing exit hole 14 shown in FIGS. 7A and 7B. This embodiment provides a unique design which allows an unpivoted drive rod to be utilized with a long frame pin.

Figure 11C:
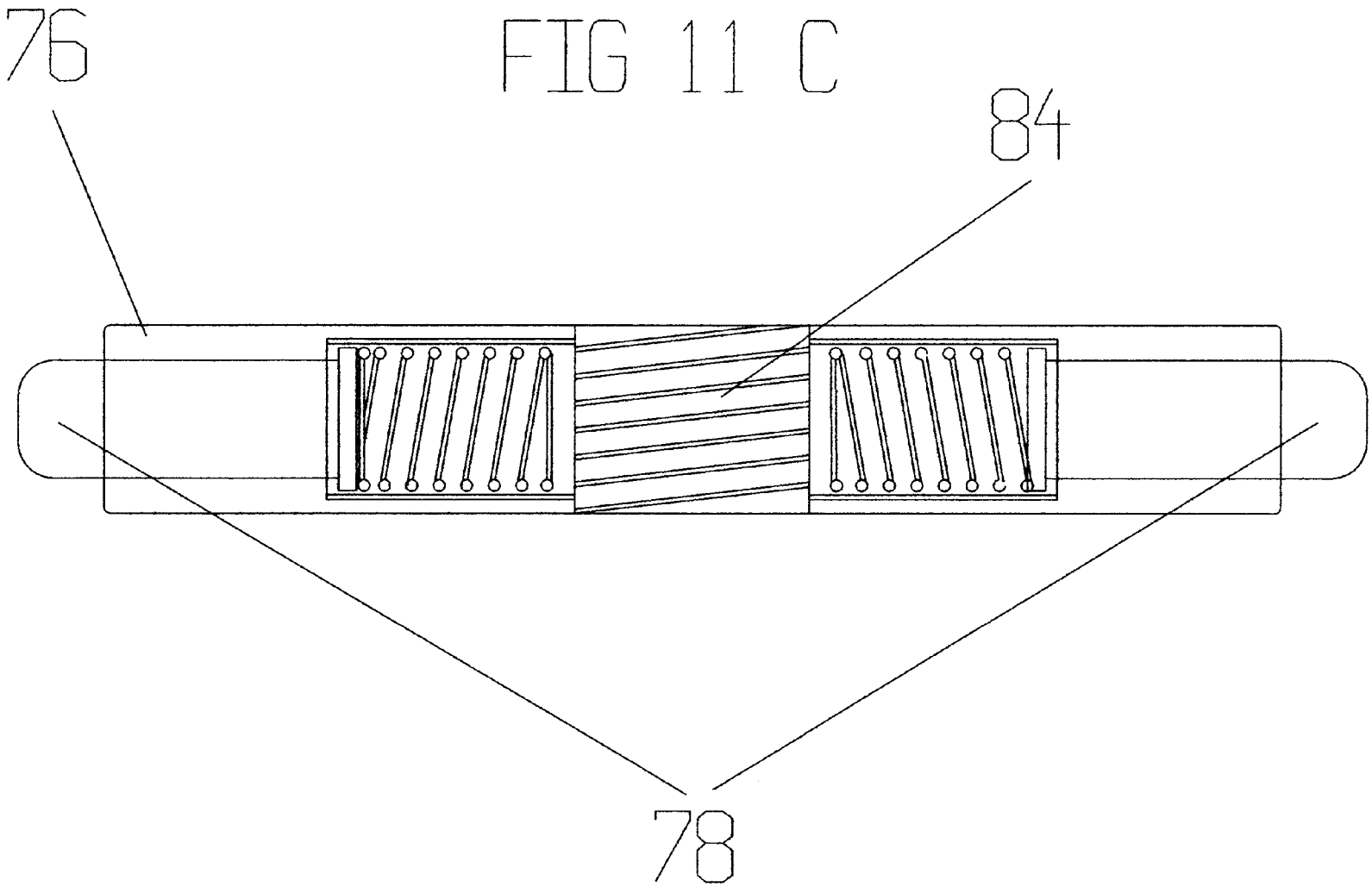
FIG. 11C shows a close up view of the frame pin shown in FIG. 11A and FIG. 11B.
Figure 12A:
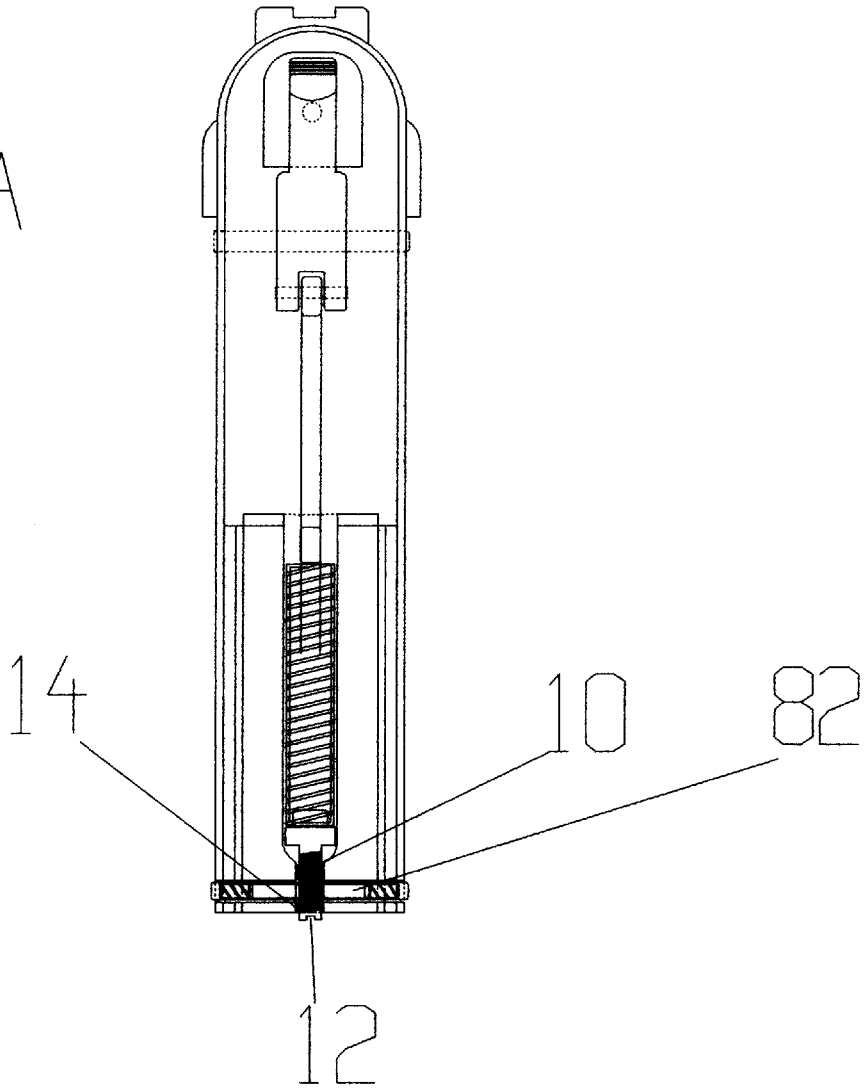
FIG. 12A shows a rear cutaway view of pistol action with an externally adjustable coil hammer mainspring assembly that has a frame pin with a unthreaded hole in its' center.
Figure 12B:
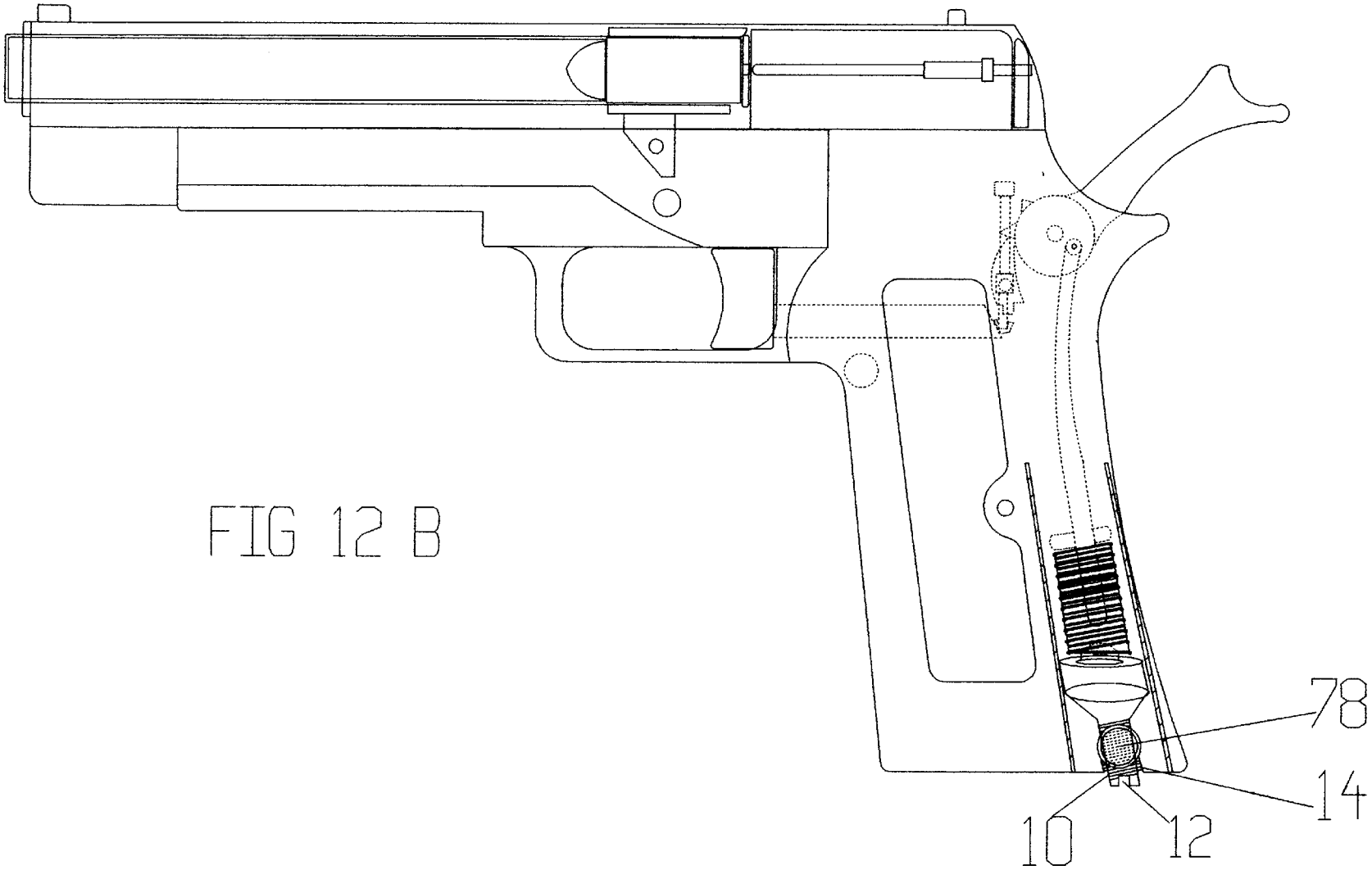
FIG. 12B shows a side view of the pistol action shown in FIG. 12A.

A tenth embodiment is illustrated—FIG. 12A and FIG. 12B show a rear cutaway and a side view respectively of a pistol action with an externally adjustable coil hammer mainspring assembly which utilizes a frame pin with unthreaded center hole 82. This pin is the same as a frame pin with center threaded hole 76 as shown in FIG. 11C except the center hole is unthreaded. Pin 82 is removed and replaced with a mainspring housing 50 from the frame of the pistol in pistols with removable housing such as the Colt 1911. A threaded drive rod 10 passes through the unthreaded center hole in pin 82 and passes through a threaded housing exit hole 14 and terminates in a slotted drive end 12. Operation of this embodiment is a described in FIG. 7A and FIG. 7B. Housing integrity is maintained in the same manner as prior art frame pin 16 in FIG. 1A and FIG. 1B.

Figure 13:
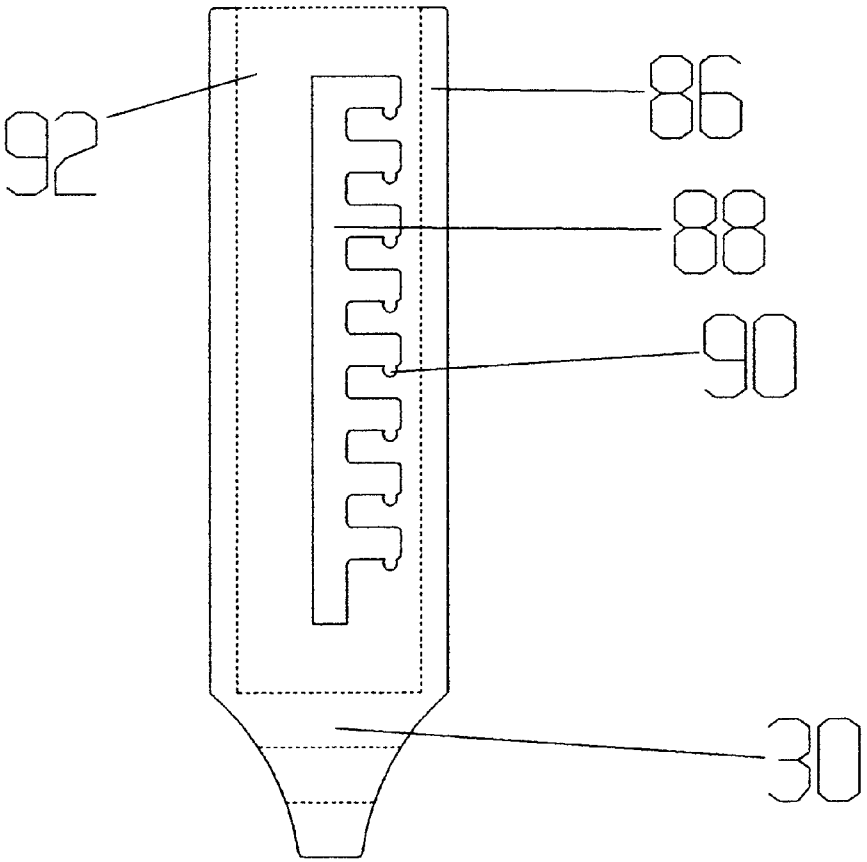
FIG. 13 shows a detailed view of a mainspring housing drive device with adjusting groove and detents.
Figure 14:
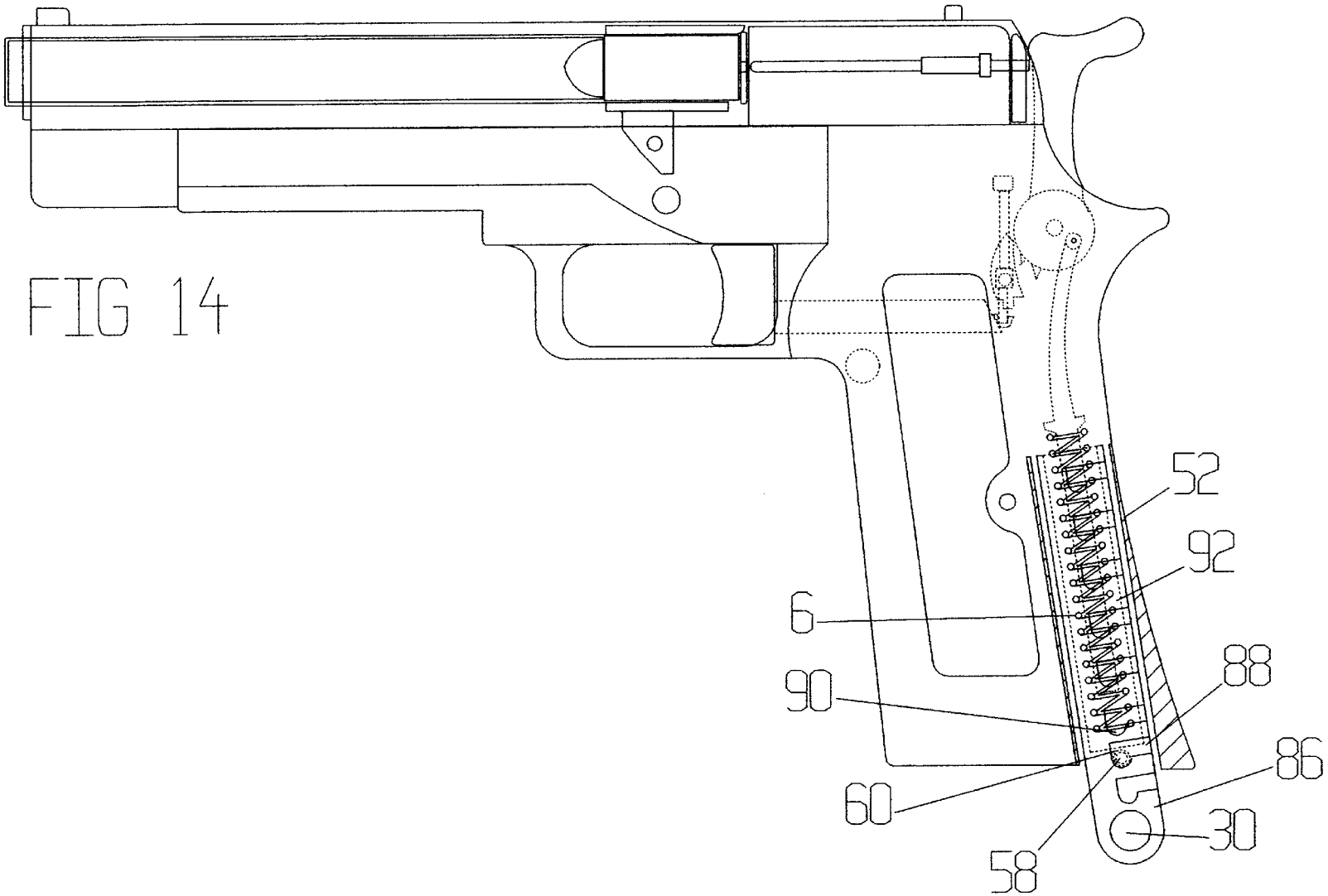
FIG. 14 shows a side view of a pistol with a mainspring housing drive device installed with a single short frame pin and adjusted to a nonsafety position.
Figure 15:
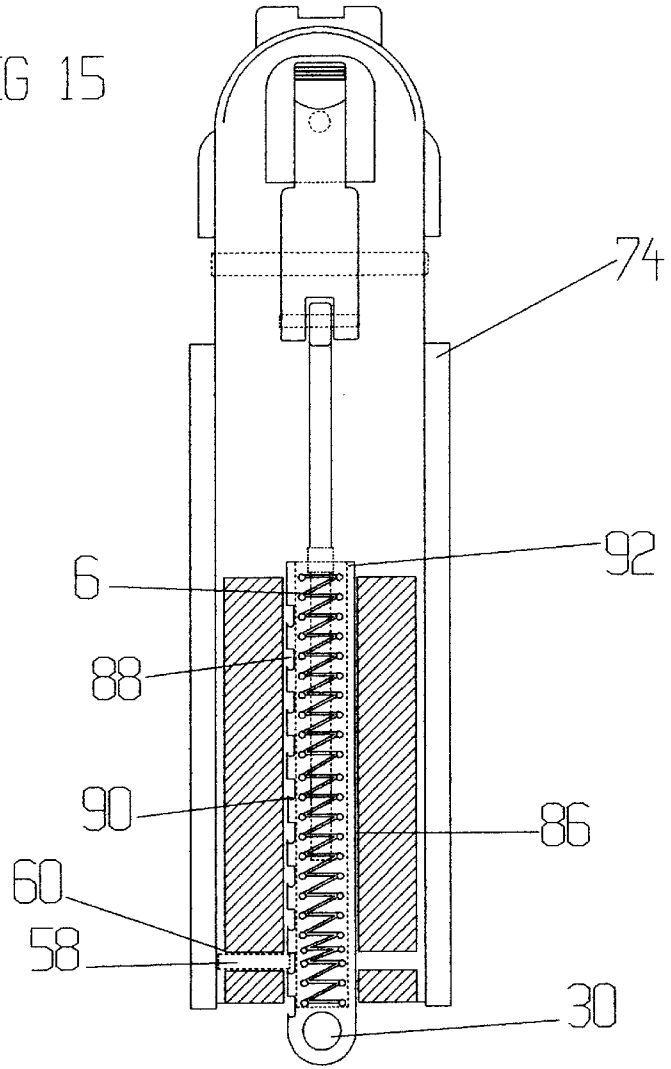
FIG. 15 shows a rear cutaway view of a pistol with a mainspring housing drive device installed with a single short frame pin and adjusted to a nonsafety engaged position.
Figure 16:
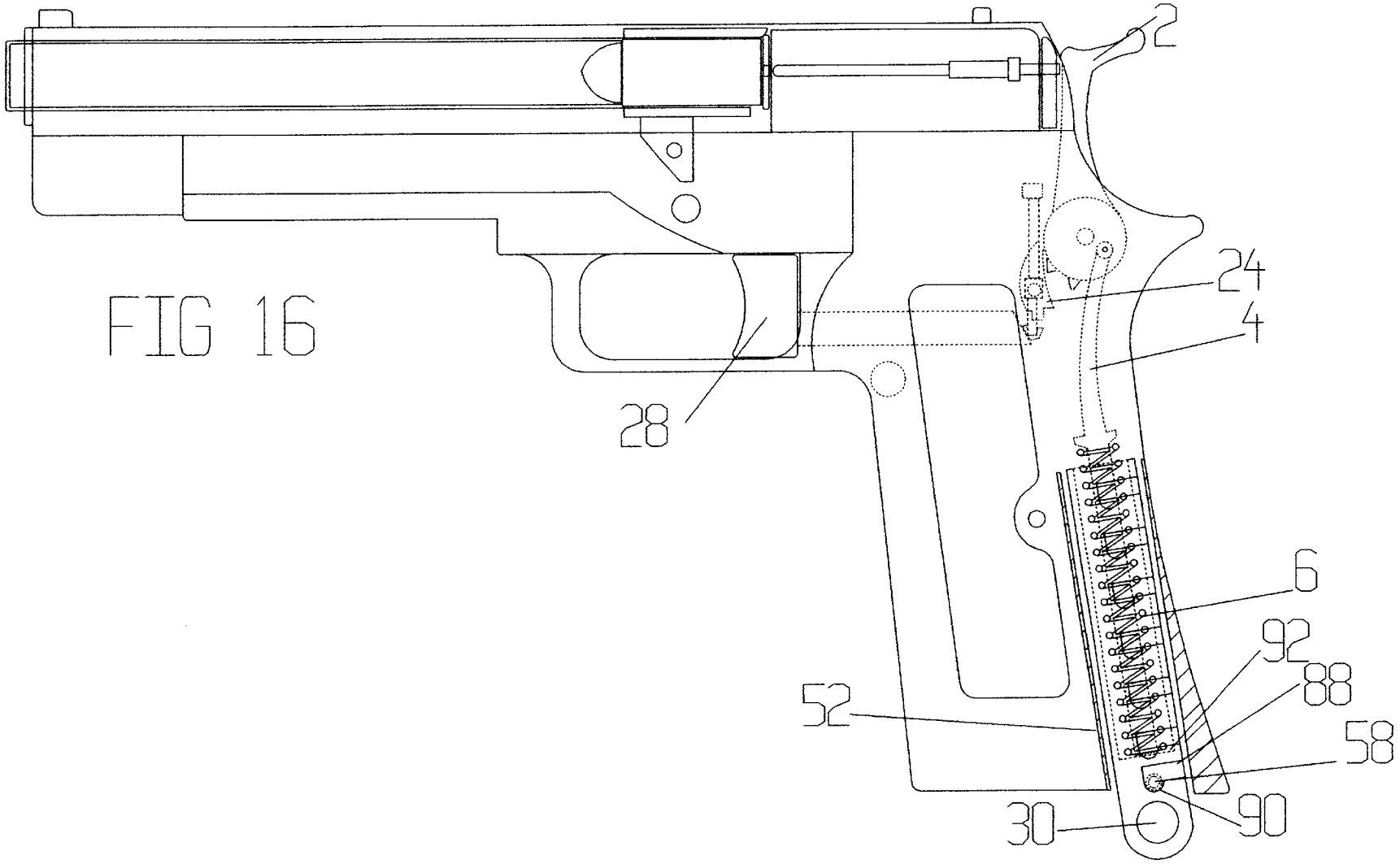
FIG. 16 shows a side view of a pistol with a mainspring housing drive device installed with a single short frame pin and adjusted to a safety engaged position.

The eleventh embodiment is illustrated in FIG. 13—in a detailed view and further illustrated installed in a pistol in FIG. 14, FIG. 15, and FIG. 16. FIG. 13—the detailed view includes a mainspring housing drive device 86, a lanyard 30, a adjusting groove 88, a detent slots 90 and a unthreaded hole in mainspring housing drive device 92. FIG. 14 and FIG. 15 show a side view and rear cutaway view respectively of a pistol with mainspring housing drive device 86 installed and includes a pistol housing 52, a gun grip 74, a coil mainspring 6, a mainspring housing drive device 86, a lanyard 30, a single short unthreaded frame pin 58, a adjusting groove 88, a detent slots 90, a unthreaded hole in pistol housing 60, and a unthreaded hole in mainspring housing drive device 92.

Installation of the eleventh embodiment is as follows. Mainspring housing drive device 86 is installed in pistol housing 52 by inserting device 86 into pistol housing 52. Single short unthreaded frame pin 58 is then inserted into unthreaded hole in pistol housing 60 and adjusting groove 88.

Operation of the eleventh embodiment is as follows. Mainspring housing drive device 86 is pushed further into the pistol housing 52 by grasping lanyard 30 and turning such that frame pin 58 is aligned with adjusting groove 88 and pushing device 86 up into pistol housing 52. Device 86 is locked into a fixed position by rotating device 86 via lanyard 30 and resting frame pin 58 in one of detent slots 90. This upward motion of device 86 pushes mainspring 6 upward. The increased coil mainspring 6 tension and subsequent effects are identical to the description of operation of FIG. 2. In order to reduce mainspring 6 tension, the process is reversed by grasping lanyard 30 and rotating to align frame pin 58 with adjusting groove 88 and allowing device 86 to be pushed down by the force of mainspring 6 and then rotating device 86 via lanyard 30 into another detent slots 90. This reduces mainspring 6 tension and subsequent effects are identical to the description of operation of FIG. 2.

FIG. 16 illustrates the safety feature included in the eleventh embodiment. Operation is very quick and easy. Device 86 is adjusted as described above except device 86 is pushed into pistol housing 52 until frame pin 58 bottoms out in the lower most point on adjusting groove 88 and then device 86 is rotated via lanyard 30 into the lower most detent slots 90. This causes hammerstrut 4 to be immobilized as it now abuts the bottom of unthreaded hole in mainspring housing drive device 92. As hammerstrut 4 is immobilized, also immobilized are hammer 2, sear 24 and trigger 28. This feature provides a novel, unique, and beneficial safety device.

Figure 17:
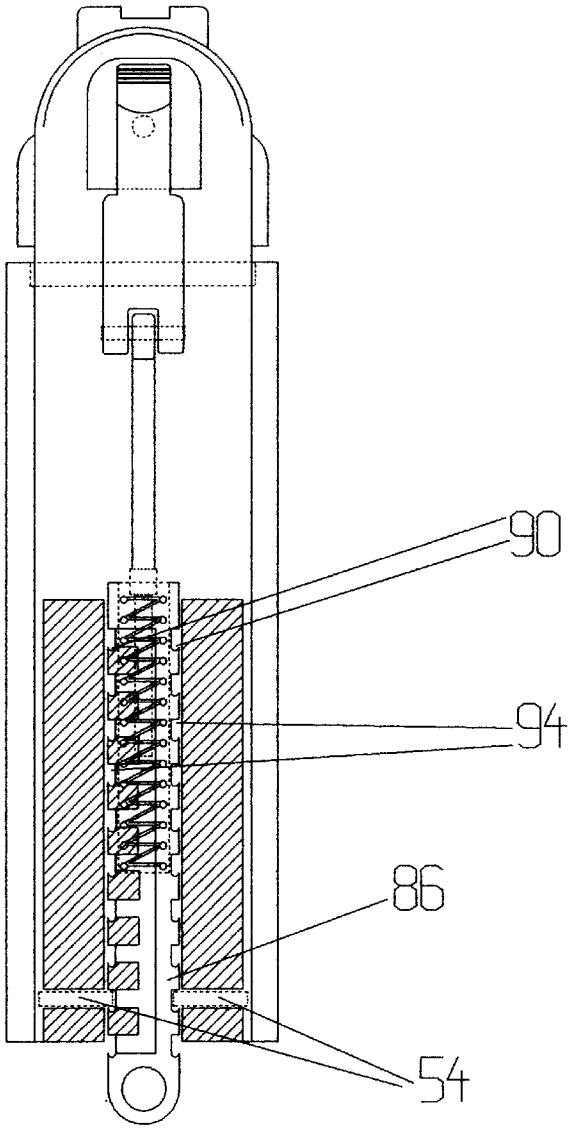
FIG. 17 shows a rear cutaway view of a pistol with a mainspring housing drive device installed with two short frame pins.

The twelfth embodiment of the present invention is illustrated—FIG. 17 which is a rear cutaway view of a pistol with a mainspring housing drive device 86 which has two adjusting grooves 94, two sets of detent slots 90 and two short unthreaded frame pins 54. Installation of this embodiment is fundamentally the same as the eleventh embodiment with insertion of frame pins 54 into two adjusting grooves 94. Operation of this embodiment is fundamentally the same as described in the eleventh embodiment above.

Figure 18A:
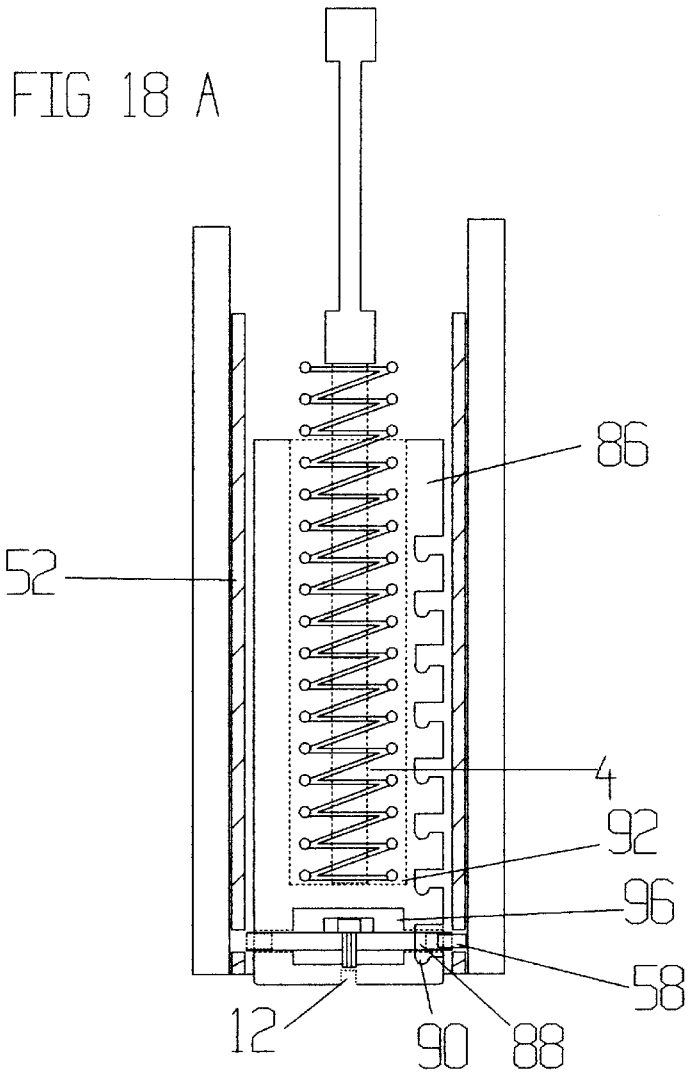
FIG. 18A shows a detailed view of a mainspring housing drive device with a key lock safety mechanism installed and in the safety engaged and locked position.
Figure 18B:
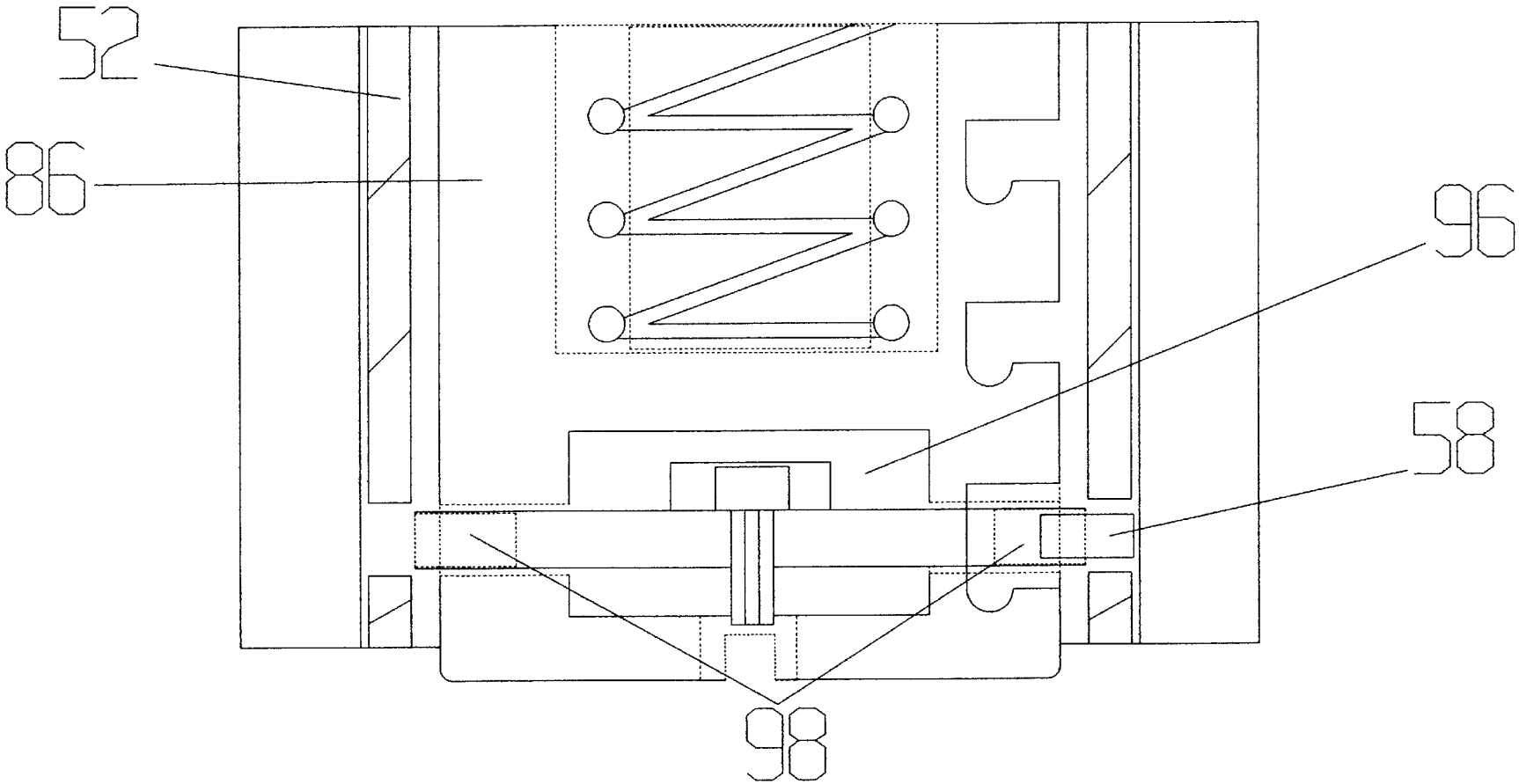
FIG. 18B shows a further detailed view of the key lock safety mechanism shown in FIG. 18A.
Figure 18C:
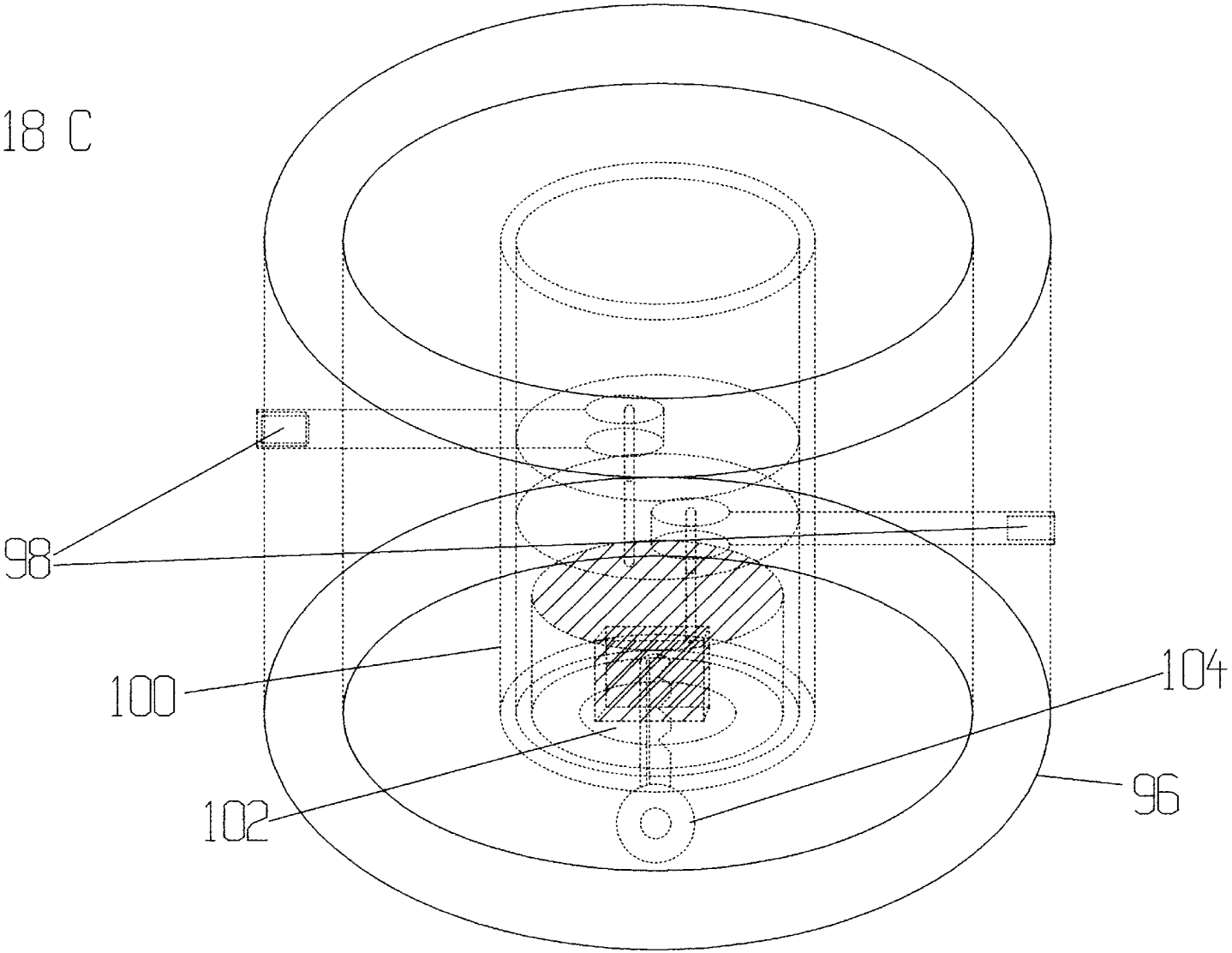
FIG. 18C shows a further detailed view of the key lock cylinder and locking pins of the key lock safety mechanism shown in FIG. 18B.
Figure 18D:
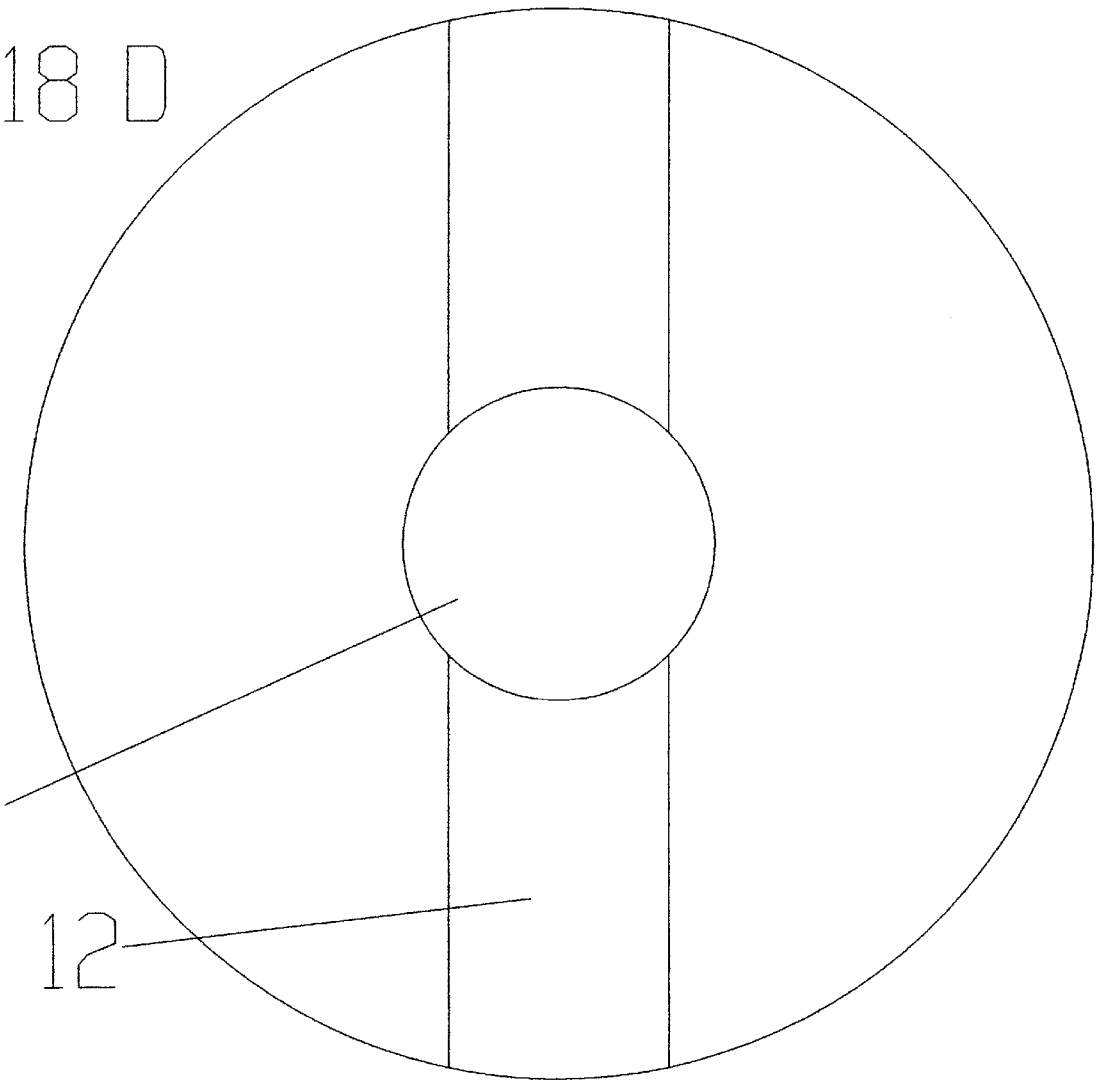
FIG. 18D shows a further detailed view of the drive slot and key hole of the key lock safety mechanism shown in FIG. 18B.
Figure 18E:
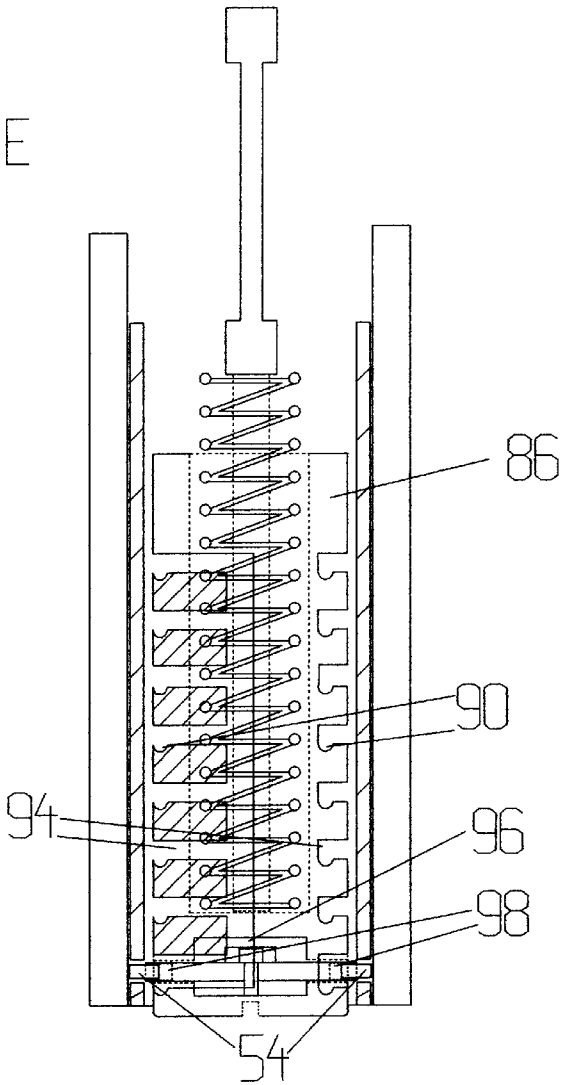
FIG. 18E shows a detailed view of a mainspring housing drive device with two adjusting grooves, two sets of detents and two frame pins with a key lock safety mechanism installed and in the safety engaged position.
Figure 19:
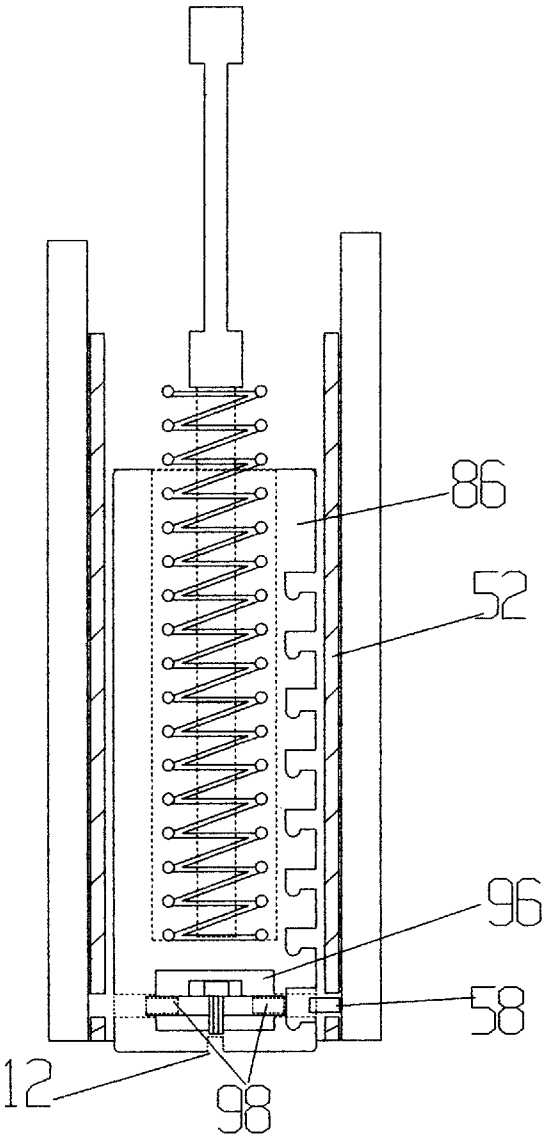
FIG. 19 shows a detailed view of a mainspring housing drive device with a key lock safety mechanism installed and in the safety engaged and unlocked position.

A thirteenth embodiment is illustrated—FIG. 18A, FIG. 18B, FIG. 18C, FIG. 18D, FIG. 18E and FIG. 19 which show various detailed views of a key locking safety mechanism 96 which is incorporated into a mainspring housing drive device 86. FIG. 18A shows a detailed view of mainspring housing drive device 86 with key locking safety mechanism 96 which is in the safety engaged position. FIG. 18B shows a closeup detailed view of mechanism 96 which show a safety locking hollow pins 98 which, when safety mechanism 96 is engaged, slip over a frame pin 58 and prevent mainspring housing drive device 86 from moving relative to pistol housing 52. FIG. 18C shows another detailed view of mechanism 96 which shows a key hole slot 102, a key lock cylinder 100 and a safety locking hollow pins 98. FIG. 18D shows a detailed view of key hole slot 102 and a slotted drive end 12, drive end 12 utilized to position mainspring housing drive device 86 in pistol housing 52 in lieu of a lanyard 30 (see FIG. 16). FIG. 19 shows safety mechanism 96 in a safety nonlocking position, safety hollow locking pins 98 being disengaged from frame pin 58, allowing mainspring housing drive device 86 to be moved relative to a pistol housing 52 utilizing a slotted drive end 12.

Operation of the thirteenth embodiment is simple. In FIG. 18A, drive device 86 is pushed into pistol housing 52 via slotted drive end 12 utilizing a flat blade screwdriver or a coin until frame pin 58 bottoms out in the lowest point on adjusting groove 88 and then device 86 is rotated via slotted drive end 12 into the lower most of detent slots 90. Key 104 is then inserted into keyhole slot 102 (see FIG. 18C and FIG. 18D) and key lock cylinder 100 is rotated via key 104 which causes safety locking pins 98 to move and engage frame pin 58 (see FIG. 18B). Key 104 is removed and as hammerstrut 4 now abuts the bottom of a unthreaded hole in mainspring housing drive device 92, the pistol is now safe as described in the eleventh embodiment above. To unlock the key locking safety mechanism 96, key 104 is inserted into keyhole slot 102 and key lock cylinder 100 is rotated via key 104 which causes safety locking pins 98 to move and disengage frame pin 58. Key 104 is removed and the pistol is still safe but unlocked (see FIG. 19). To disengage the safety, drive device 86 is repositioned utilizing a coin or flat head screwdriver in drive end 12 to another detent slots 90 via adjusting groove 88.

FIG. 18E shows a detailed view of a mainspring housing drive device 86 with a key locking safety mechanism 96 which is in the safety engaged position FIG. 18E is fundamentally the same as this thirteenth embodiment except FIG. 18E shows the use of two short unthreaded frame pins 54, two sets of detent slots 90 and two adjusting grooves 94. Operation of FIG. 18E is the same as described in this thirteenth embodiment except that two frame pins 54 are engaged by safety locking pins 98. This thirteenth embodiment provides a novel, unique and useful locking safety mechanism which can be locked/unlocked quickly and easily for engaging and disengaging a pistol safety.

Figure 20:
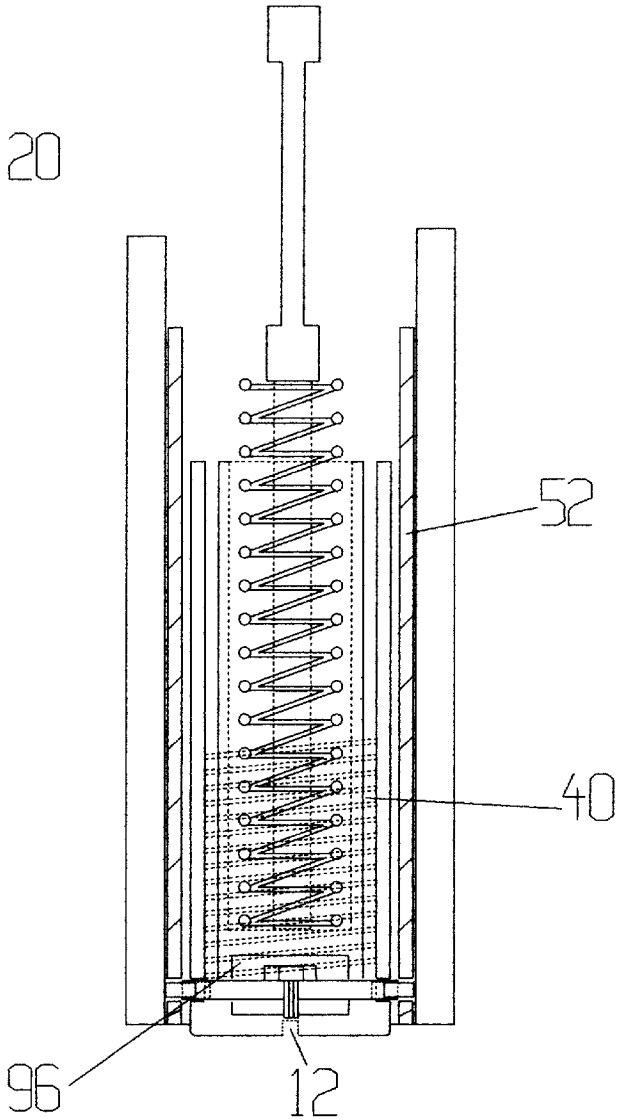
FIG. 20 shows a detailed view of a threaded plug with a key lock safety mechanism installed and in the safety engaged and locked position.

A fourteenth embodiment is illustrated—FIG. 20 which shows a key locking safety mechanism 96 incorporated into a threaded plug 40. The key locking safety mechanism 96 operates as described in the thirteenth embodiment and the threaded plug 40 operates as described in the third embodiment except threaded plug 40 is moved relative to a pistol housing 52 via a slotted drive end 12 to permit both trigger-pull adjustment and to align plug 40 with a key lock safety mechanism 96 to allow the pistol user to engage the safety. This embodiment shows the versatility of the present invention in that a safety can be incorporated into different embodiments of the present invention.

From the description above, a number of advantages of the present invention become evident:

(a) A choice of different finger-adjustable drive mechanisms to fit the particular design features of the pistol and the preference of the user is available.

(b) Fingertip trigger-pull and hammerfall force adjustments are made available on a wide range of pistols where none existed before.

(c) A range of material types (steel, titanium, delrin etc.) could be used in making the assembly to fit user requirements.

(d) Multiple pistol action design approaches are made available to facilitate individual pistol model modifications and to make external coil hammer mainspring adjustment available to a wide range of different pistol models.

(e) A pistol with a broken mainspring may, in many cases, be made to function by rotating the external drive mechanism in a clockwise direction, compressing the broken mainspring until enough mainspring tension is restored to cause sufficient hammerfall force to enable projectile ignition.

(f) A unique and fast operating pistol safety device is now available which can be manufactured utilizing locking (key lock, combination lock, etc) and nonlocking mechanisms.

SUMMARY, RAMIFICATIONS, AND SCOPE

Accordingly, it is seen that the externally adjustable coil hammer mainspring of this invention can be used to field-adjust hammerfall and trigger-pull easily and conveniently for pistols which previously did not have this capability. No gunsmithing services of any kind are required to make these adjustments. The savings in gun down time and gunsmithing charges are substantial. Furthermore, the externally adjustable mainspring has the additional advantages in that

- it provides for a variety of finger-adjustable turning mechanisms such that no mechanical tools of any kind are required—a real plus in the field;
- it provides for coil mainspring change-out by the user, without tools, in many of the designs;
- it provides for a variety of internal/external mechanisms and material compositions to fit the pistol design and the needs of the pistol owner;
- the safety mechanisms provided by this invention locks down the firing train; trigger, sear, hammer and hammerstrut—the pistol will not fire; and
- the trigger-pull hammerfall and safety adjustments are quick and easy.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

What is claimed is:

1. A pistol comprising a pistol housing including a barrel through which projectiles may be fired, a trigger mounted in said pistol housing, an abutment member, a hammer pivotally mounted in said pistol housing and operatively connected to said trigger for pivoting toward a firing position when said trigger is activated to drive said abutment member into engagement with a projectile, thereby to fire said projectile through said barrel, a mainspring housing drive means disposed at least partially within said pistol housing and movable relative to said pistol housing, a helical coil mainspring disposed about an axis of elongation mounted in said mainspring housing drive means, means for securing said mainspring housing drive means within said pistol housing wherein said means for securing said mainspring housing drive means within said pistol housing comprises a frame pin extending transversely relative to said axis of elongation, said mainspring housing drive means being spaced from said frame pin, connecting means for connecting said mainspring to said hammer for activating said hammer to drive said hammer rapidly and forcefully to said firing position, said mainspring housing drive means modulating a force said mainspring applies to said hammer, said mainspring housing drive means having a first end disposed in abutment with said mainspring remote from said connecting means.

2. A pistol as recited in claim 1, wherein said frame pin is bifurcated into two spaced apart members, said mainspring housing drive means adjacent said two spaced apart members.

* * * * *